US009420394B2

(12) United States Patent
Eppolito

(10) Patent No.: US 9,420,394 B2
(45) Date of Patent: Aug. 16, 2016

(54) PANNING PRESETS

(75) Inventor: Aaron M. Eppolito, Santa Cruz, CA (US)

(73) Assignee: APPLE INC., Cupertino, CA (US)

( * ) Notice: Subject to any disclaimer, the term of this patent is extended or adjusted under 35 U.S.C. 154(b) by 735 days.

(21) Appl. No.: 13/151,199

(22) Filed: Jun. 1, 2011

(65) Prior Publication Data

US 2012/0207309 A1 Aug. 16, 2012

Related U.S. Application Data

(60) Provisional application No. 61/443,711, filed on Feb. 16, 2011, provisional application No. 61/443,670, filed on Feb. 16, 2011.

(51) Int. Cl.

| | |
|---|---|
| ***H04R 5/00*** | (2006.01) |
| ***H04S 7/00*** | (2006.01) |
| *H04S 1/00* | (2006.01) |
| *H04S 3/00* | (2006.01) |

(52) U.S. Cl.

CPC . *H04S 7/40* (2013.01); *H04S 1/002* (2013.01); *H04S 1/007* (2013.01); *H04S 3/002* (2013.01); *H04S 3/008* (2013.01); *H04S 7/305* (2013.01); *H04S 2400/03* (2013.01); *H04S 2400/11* (2013.01); *H04S 2400/15* (2013.01)

(58) Field of Classification Search

CPC .... G10H 2210/305; G10H 1/02; H04S 1/002; H04S 1/007; H04S 3/002; H04S 3/008; H04S 7/40; H04S 7/305; H04S 2400/03; H04S 2400/11; H04S 2400/15

USPC ..... 381/2, 17, 18, 56, 77, 80, 109, 118, 381/307; 715/730–732, 727, 716, 728

See application file for complete search history.

(56) References Cited

U.S. PATENT DOCUMENTS

| | | | | |
|---|---|---|---|---|
| 5,956,031 | A | 9/1999 | Berteig et al. | |
| 6,507,658 | B1 | 1/2003 | Abel et al. | |
| 6,850,254 | B1 | 2/2005 | Banning et al. | |
| 7,039,876 | B2 | 5/2006 | Lavendel et al. | |
| 7,092,542 | B2 * | 8/2006 | McGrath | 381/307 |
| 7,221,379 | B2 | 5/2007 | Mullins et al. | |
| 7,383,509 | B2 | 6/2008 | Foote et al. | |

(Continued)

OTHER PUBLICATIONS

Sony, Vegas Pro 9 User Manual, Apr. 2, 2010, p. 178, 180, 244-247, 404-405.*

(Continued)

*Primary Examiner* — Vivian Chin
*Assistant Examiner* — William A Jerez Lora
(74) *Attorney, Agent, or Firm* — Adeli LLP

(57) ABSTRACT

For media clips having audio content, a novel method for applying panning behaviors to the audio content is presented. The method receives a selection of a media clip having audio content and a selection of a panning preset for modifying a set of audio parameters of the audio content to create an audio panning effect. Each panning preset is associated with several sets of values where each set of values corresponds to the set of audio parameters. The audio parameters include parameters for determining a distribution of the audio content across a multi-channel output system. The method applies each the sets of values associated with the selected panning preset to successive portions of the audio content in order to control the distribution of the audio content to the multi-channel output system.

24 Claims, 23 Drawing Sheets

(56) References Cited

U.S. PATENT DOCUMENTS

| | | | | |
|---|---|---|---|---|
| 7,548,791 | B1 | 6/2009 | Johnston | |
| 7,549,123 | B1 | 6/2009 | Stewart et al. | |
| 7,653,550 | B2 | 1/2010 | Schulz | |
| 7,698,009 | B2 | 4/2010 | Cotey et al. | |
| 7,756,281 | B2 | 7/2010 | Goldstein et al. | |
| 7,805,685 | B2 * | 9/2010 | Cannistraro | G06F 3/04847 345/156 |
| 7,873,917 | B2 | 1/2011 | Brinkmann et al. | |
| 7,957,547 | B2 * | 6/2011 | Chin | G11B 27/34 345/440.1 |
| 8,767,970 | B2 | 7/2014 | Eppolito | |
| 8,887,074 | B2 | 11/2014 | Sheeler et al. | |
| 2002/0177967 | A1 | 11/2002 | Fuchs et al. | |
| 2002/0190991 | A1 | 12/2002 | Efran et al. | |
| 2003/0039408 | A1 | 2/2003 | Smith | |
| 2004/0030425 | A1 * | 2/2004 | Yeakel | H04H 60/04 700/94 |
| 2004/0066396 | A1 | 4/2004 | Hatakenaka | |
| 2004/0136549 | A1 * | 7/2004 | Pennock | G10H 1/02 381/119 |
| 2006/0066628 | A1 | 3/2006 | Brodie et al. | |
| 2007/0287490 | A1 | 12/2007 | Green et al. | |
| 2008/0002844 | A1 | 1/2008 | Chin | |
| 2008/0095380 | A1 | 4/2008 | Hanna | |
| 2008/0232617 | A1 | 9/2008 | Goodwin et al. | |
| 2008/0253577 | A1 | 10/2008 | Eppolito | |
| 2008/0253592 | A1 | 10/2008 | Sanders et al. | |
| 2009/0091563 | A1 | 4/2009 | Viz et al. | |
| 2009/0129601 | A1 | 5/2009 | Ojala et al. | |
| 2009/0144063 | A1 | 6/2009 | Beack et al. | |
| 2010/0157726 | A1 * | 6/2010 | Ando | H04S 7/308 367/7 |
| 2010/0189266 | A1 | 7/2010 | Oh et al. | |
| 2010/0199204 | A1 | 8/2010 | Oh et al. | |
| 2011/0007915 | A1 | 1/2011 | Park | |
| 2011/0145743 | A1 | 6/2011 | Brinkmann et al. | |
| 2012/0210223 | A1 | 8/2012 | Eppolito | |
| 2012/0210262 | A1 | 8/2012 | Sheeler et al. | |

OTHER PUBLICATIONS

Sony, Vegas Pro 9 User Manual, Apr. 2, 2010, p. 178,180,244-247, 404-405.*

Sony, Vegas Pro 9 User Manual, p. 178, 180, 244-246, 405.*

U.S. Appl. No. 13/105,858, filed May 11, 2011, Sheeler, Stephen, et al.

U.S. Appl. No. 13/151,181, filed Jun. 1, 2011, Eppolito, Aaron M.

Portions of prosecution history of U.S. Appl. No. 11/271,081, filed Dec. 10, 2010, Brinkmann, Ron, et al.

Authr Unknown, "Additional Presets, " Month Unknown, 2007, pp. 1-2, iZotope, Inc.

Author Unknown, "Octogris by UDM," Month Unknown, 2000-2011, pp. 1-3, KVR Audio Plugin Resources.

Author Unknown, "PCM 81 Presets," Month Unknown, 1989, Lexicon, Bedford Massachusetts, USA.

Author Unknown, "Spectron—64-bit Spectral Effect Processor," Month Unknown, 2007, pp. 1-3, iZotope, Inc.

Lee. Taejin, et al., "A Personalized Preset-Based Audio System for Interactive Service," Audio Engineering Society (AES) 121st Convention, Oct. 5-8, 2006, pp. 1-6, San Francisco, CA, USA.

Author Unknown, "Using Adobe premiere elements 8 Editor,", last updated Aug. 12, 2010, pp. 146-167, Adobe Systems Incorporated, San Jose, California, USA.

Author Unknown, "Adobe Premiere Pro CS3: User Guide," Apr. 1, 2008, pp. 240-278, Adobe Systems Incorporated, San Jose, California, USA.

* cited by examiner

PANNING PRESETS

CLAIM OF BENEFIT TO PRIOR APPLICATIONS

The present application claims the benefit of U.S. Provisional Patent Application 61/443,711, entitled, "Panning Presets", filed Feb. 16, 2011, and U.S. Provisional Patent Application 61/443,670, entitled, "Audio Panning with Multi-Channel Surround Sound Decoding", filed Feb. 16, 2011. The contents of U.S. Provisional Patent Application 61/443,711 and U.S. Provisional Patent Application 61/443,670 are hereby incorporated by reference.

BACKGROUND

Digital graphic design, image editing, audio editing, and video editing applications (hereafter collectively referred to as media content editing applications or media-editing applications) provide graphical designers, media artists, and other users with the necessary tools to create a variety of media content. Examples of such applications include Final Cut Pro® and iMovie®, both sold by Apple® Inc. These applications give users the ability to edit, combine, transition, overlay, and piece together different media content in a variety of manners to create a resulting media project. The resulting media project specifies a particular sequenced composition of any number of text, audio clips, images, or video content that is used to create a media presentation.

Various media-editing applications facilitate such composition through electronic means. Specifically, a computer or other electronic device with a processor and computer readable storage medium executes the media content editing application. In so doing, the computer generates a graphical interface whereby editors digitally manipulate graphical representations of the media content to produce a desired result.

In many cases, media content is recorded by a video recorder coupled to multiple microphones. Multi-channel microphones are used to capture sound from an environment as a whole. Multi-channel microphones add lifelike realism to a recording because multi-channel microphones are able to capture left-to-right position of each source of sound. Multi-channel microphones can also determine depth or distance of each source and provide a spatial sense of the acoustic environment. To further enhance the media content, editors use media-editing applications to decode and process audio content of the media clips to produce desired effects. One example of such decoding is to produce an audio signal with additional channels from the multi-channel recording (e.g., converting a two-channel recording into a five-channel audio signal). With the undecoded and decoded signals, editors are able to author desired audio effect representing motion through certain advance sound processing. The media-editing application may further save these authored audio effects as presets for future application to media clips.

BRIEF SUMMARY

Some embodiments of the invention provide several selectable presets that produce panning behaviors in media content items (e.g., audio clips, video clips, etc.). The panning presets are applied to media clips to produce behaviors such as sound panning in a particular direction or along a predefined path. Other preset panning behaviors include transitioning audio between audio qualitative settings (i.e., outputting primarily stereo audio versus outputting ambient audio). By utilizing panning presets to produce desired effects, a user is able to incorporate high-level behaviors into media clips that typically require extensive keyframe editing to produce.

In order to produce the desired effects, audio portions of media clips are generally recorded by multiple microphones. Multiple channels recording the same event will produce similar audio content; however, each channel will have certain distinct characteristics (e.g., timing delay and sound level). These multi-channel recordings are subsequently decoded to produce additional channels in some embodiments. This technique of producing multi-channel surround sound is often referred to as upmixing. Asymmetrically outputting the decoded audio signals to a multi-channel speaker system creates an impression of sound being heard from various directions. Additionally, the application of panning presets to further modulate the individual outputs to each channel of the multi-channel speaker system as a function of time provides a sense of movement to the listening audience.

In some embodiments, the sound reproduction quality of an audio source is enriched by altering several audio parameters of the decoded audio signal before the signal is sent to the multiple channels (i.e., at the time when the media is authored/edited or at run-time). The parameters include an up/down mixer that provides adjustments for balance (also referred to as original/decoded), which selects the amount of original versus decoded signal, front/rear bias (also referred to as ambient/direct), left/right (L/R) steering speed, and left surround/right surround (Ls/Rs) width (also referred to as surround width) in some embodiments. The parameters further include advanced settings such as rotation, width (also referred to as stereo spread), collapse (also referred to as attenuate/collapse) which selects the amount of collapsing versus attenuating panning, center bias (also referred to as center balance), and low frequency effects (LFE) balance. The alteration of parameters enhances the audio experience of an audience by replicating audio qualities (i.e., echo/reverberation, width, direction, etc.) representative of live experiences.

In some embodiments, the above listed parameters are interdependent on one another within a panning preset. For example, within a particular panning preset, changing the rotation value of a first set of parameter values causes a change in one or more of the other parameter values, thus resulting in a second set of parameters. The sets of parameter values are represented as states of the particular panning preset, and each panning preset includes at least two states. Additional sets of parameter values are provided by the user at the time of authoring or interpolated from the two or more defined states of the effect in some embodiments.

The combination of directional and qualitative characteristics provided by the audio processing and panning presets provides a dynamic sound field experience to the audience. The multi-channel speaker system encircling the audience outputs sound from all directions of the sound field. Altering the asymmetry of the audio output in the multi-channel speaker system as a function of time creates a desired panning effect. While soundtracks of movies represent a major use of such processing techniques, the multi-channel application is used to create audio environments for a variety of purposes (i.e., music, dialog, ambience, etc.).

The preceding Summary is intended to serve as a brief introduction to some embodiments of the invention. It is not meant to be an introduction or overview of all inventive subject matter disclosed in this document. The Detailed Description that follows and the Drawings that are referred to in the Detailed Description will further detail the embodiments described in the Summary as well as other embodiments. Accordingly, to understand all the embodiments described by this document, a full review of the Summary, Detailed Description and the Drawings is needed. Moreover, the claimed subject matters are not to be limited by the illustrative details in the Summary, Detailed Description and the Drawings, but rather are to be defined by the appended claims, because the claimed subject matters can be embodied in other specific forms without departing from the spirit of the subject matters.

BRIEF DESCRIPTION OF THE DRAWINGS

For purpose of explanation, several embodiments of the invention are set forth in the following figures.

DETAILED DESCRIPTION

In the following description, numerous details are set forth for purpose of explanation. However, one of ordinary skill in the art will realize that the invention may be practiced without the use of these specific details. For instance, many of the examples illustrate the application of particular panning presets to audio signals of media clips. One of ordinary skill will realize that these are merely illustrative examples, and that the invention can apply to a variety of panning presets that involve the adjustment of several audio parameters to achieve. Furthermore, many of the examples are used to illustrate processing audio signals that have been decoded to a five-channel signal. One of ordinary skill will realize that the same processing may also be performed on audio signals that include a variety of channels (i.e., two-channel stereo, seven-channel surround, nine-channel surround, etc.). In other instances, well known structures and devices are shown in block diagram form in order to not obscure the description of the invention with unnecessary details.

In some embodiments of the invention, application of the panning presets is performed by a computing device. Such a computing device can be an electronic device that includes one or more integrated circuits (IC) or a computer executing a program, such as a media-editing application.

I. Overview

A. Static Panning Preset

Figure 1:
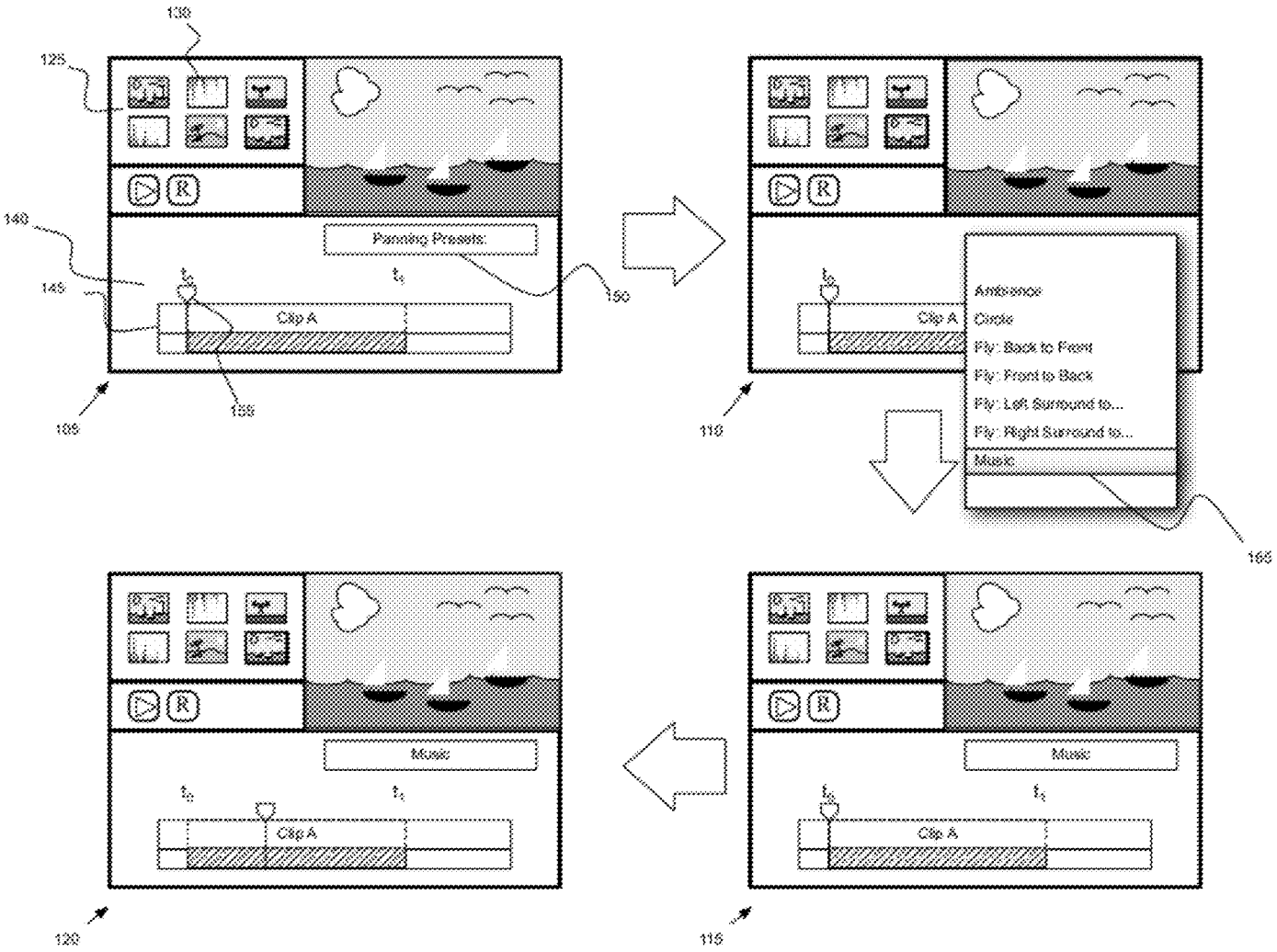
FIG. 1 conceptually illustrates a graphical user interface (UI) for the application of a static panning preset in some embodiments.

FIG. 1 conceptually illustrates a graphical user interface (UI) for the selection and application of a static panning preset in some embodiments. A static panning preset is a preset whose set of parameter values, when applied to a media clip, does not change over time.

At the first stage 105, the user selects a media clip 130 from a library 125 of media clips. Upon making a selection, the media clip is placed in the media clip track 145 in the timeline area 140. The media clip 145 track includes a playhead 155 indicating the progress of playback of the media clip.

The UI also provides a drop-down menu 150 from which the user selects the panning presets. The selection is received through a user selection input such as input received from a cursor controller (e.g., a mouse, touchpad, trackpad, etc.), from a touchscreen (e.g., a user touching a UI item on a touchscreen), from keyboard input (e.g., a hotkey or key sequence), etc. The term user selection input is used throughout this specification to refer to at least one of the preceding ways of making a selection or pressing a button through a user interface.

As shown in the second stage 110, the user selects the "Music" panning preset 165, which is subsequently highlighted. The Music preset in this example does not provide any adjustable values. Accordingly, a single set of audio parameters representing the Music preset is applied throughout the media clip. The third stage 115 and the fourth stage 120 illustrate the progression of playback of the media clip to which the Music preset has been applied.

B. Static Panning Preset with Single Adjustable Value

Figure 2:
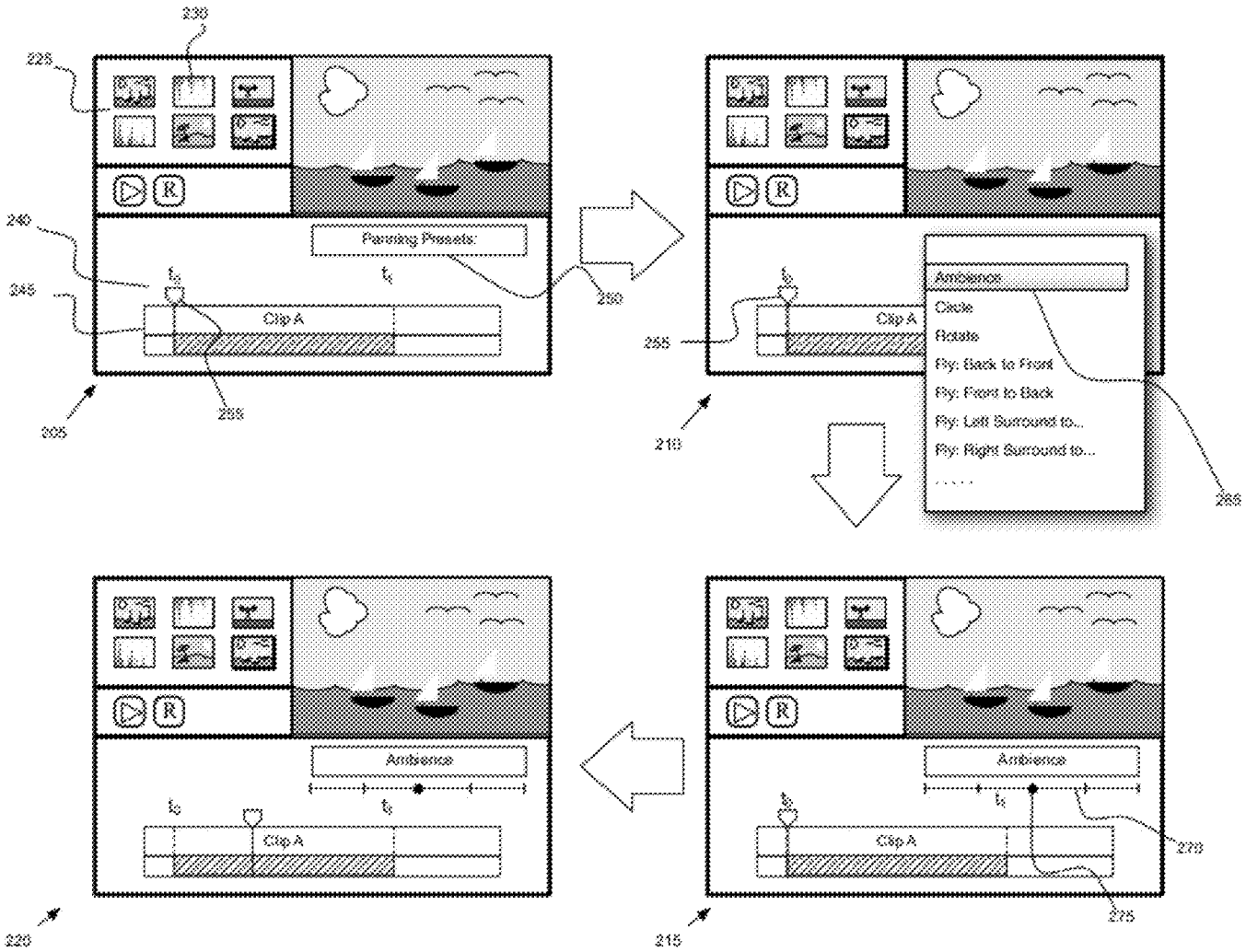
FIG. 2 conceptually illustrates a UI for the application of a static panning preset with a single adjustable value in some embodiments.

FIG. 2 conceptually illustrates a UI for the selection and application of a static panning preset with a single adjustable value in some embodiments. As described above, a static panning preset is a preset whose set of parameter values, when applied to a media clip, does not change over time. In this embodiment, a user selects a value representing the level of effect of the preset to be applied throughout the media clip.

At the first stage 205, the user selects a media clip 230 from a library 225 of media clips. Upon making a selection, the media clip is placed in the media clip track 245 in the timeline area 240. The media clip track 245 includes a playhead 255 indicating the progress of playback of the media clip.

The UI also provides a drop-down menu 250 from which the user selects the panning preset. As shown in the second stage 210, the user selects the "Ambience" panning preset 265, which is subsequently highlighted. Upon selection of a panning preset, a slider control 275 and a slider track 270 is provided to the user for setting a level of effect. By selecting the amount value, the user indicates a particular level of audio effect that the user would like to have applied throughout the media clip. In this example, the user sets the amount value by setting the slider control 275 at the middle of the slider track 270. Accordingly, a set of audio parameters corresponding to the position of the slider control 275 is applied to the entire media clip. If a user changes the position of the slider control 275 to indicate a selection of a different level of audio effect, a different set of audio parameters corresponding to the newly selected slider controller position is applied throughout the media clip to produce the desired audio effect. The third stage 215 and the fourth stage 220 illustrate the progression of playback of the media clip to which the Music preset has been applied. Since the same audio effect is applied throughout the media clip, the slider control 275 position does not change during playback.

C. Dynamic Panning Preset

Figure 3:
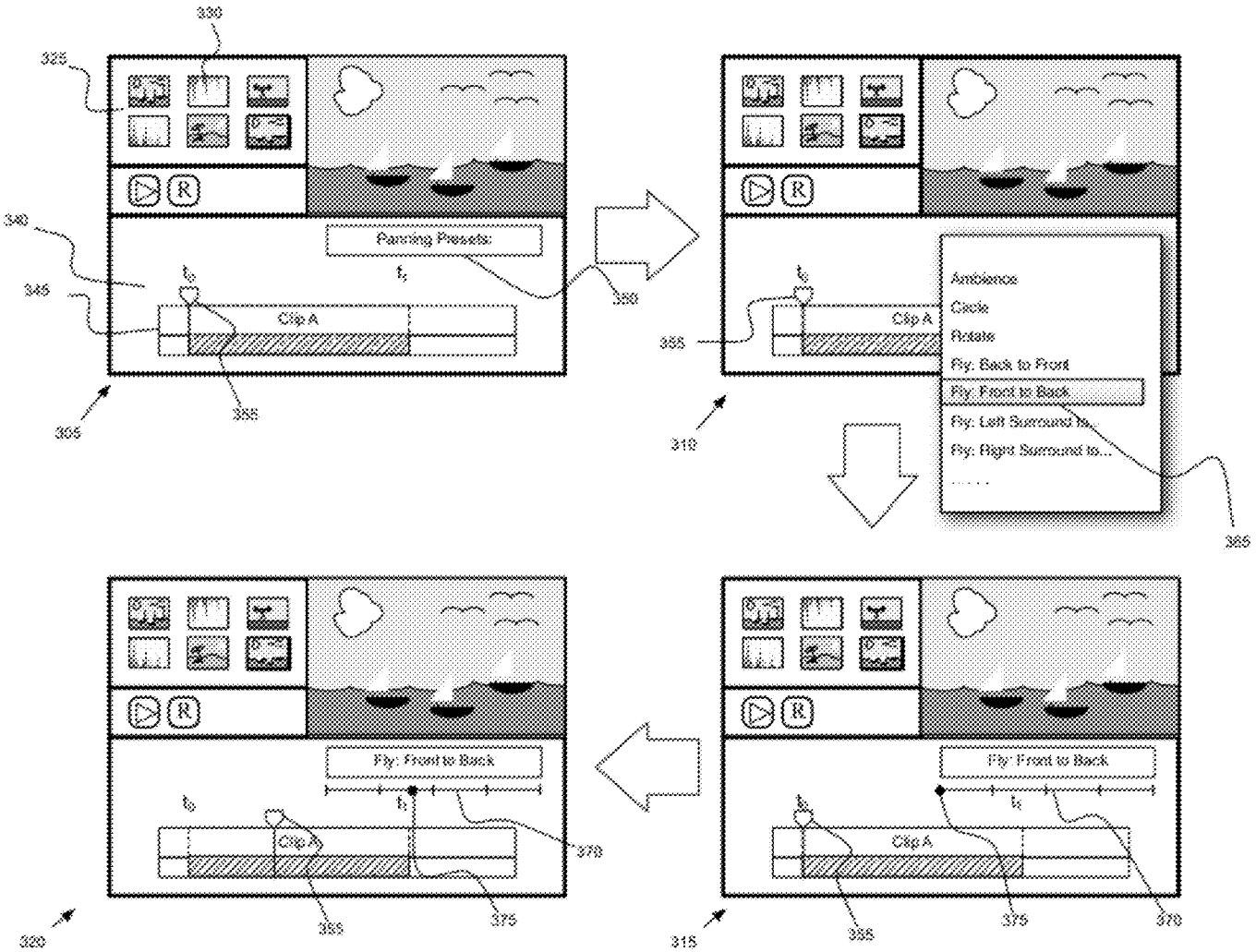
FIG. 3 conceptually illustrates a UI for the application of a dynamic panning preset in some embodiments.

FIG. 3 conceptually illustrates a UI for the selection and application of a dynamic panning preset in some embodiments. A dynamic preset is a preset that applies sets of parameters as a function of time. An example of a dynamic preset is a "Fly: Front to Back" effect, as shown in this example.

At the first stage 305, the user selects a media clip 330 from a library 325 of media clips. Upon making a selection, the media clip is placed in the media clips track 345 in the timeline area 340. The media clips track includes a playhead 355 indicating the progress of playback of the media clip.

The UI also provides a drop-down menu 350 from which the user selects the panning preset. The selection of the "Fly: Front to Back" preset 365 is shown in the second stage 310, and the selected preset is subsequently highlighted. Upon selection of the preset, a slider control 375 representing a position along the path of the pan effect is provided along a slider track 370 to track the progress of the pan effect.

Application of the Fly: Front to Back preset is performed dynamically throughout the media clip. Specifically, different sets of parameters representing different states of the panning preset are successively applied to the media clip as a function of time to produce the desired effect. The progression of the pan effect is illustrated by the progression from the third stage 315 to the fourth stage 320. At the third stage, the playhead 355 is shown to be at the beginning of the selected media clip. The position of the playhead along the media clip corresponds to the position of the slider control 375 on the slider track 370.

As playback of the media clip progresses as illustrated in the fourth stage 320, the playhead 355 and the slider control 375 are shown to progress proportionally along their respective tracks. Each progression in the position of the slider control 375 represents the application of a different set of parameter values. As described above, the successive application of different sets of parameter values produces the panning effect in this example.

D. Multi-Channel Content Generation

In the following description, stereo-microphones are used to produce multi-channel recordings for purpose of explanation. Furthermore, the decoding performed in the following description generates five-channel audio signals, also for the purpose of explanation. However, one of ordinary skill in the art will realize that multi-channel recordings may be performed by several additional microphones in a variety of different configurations, and the decoding of the multi-channel recording may generate audio signals with more than five channels. Accordingly, the invention may be practiced without the use of these specific details.

Figure 4:
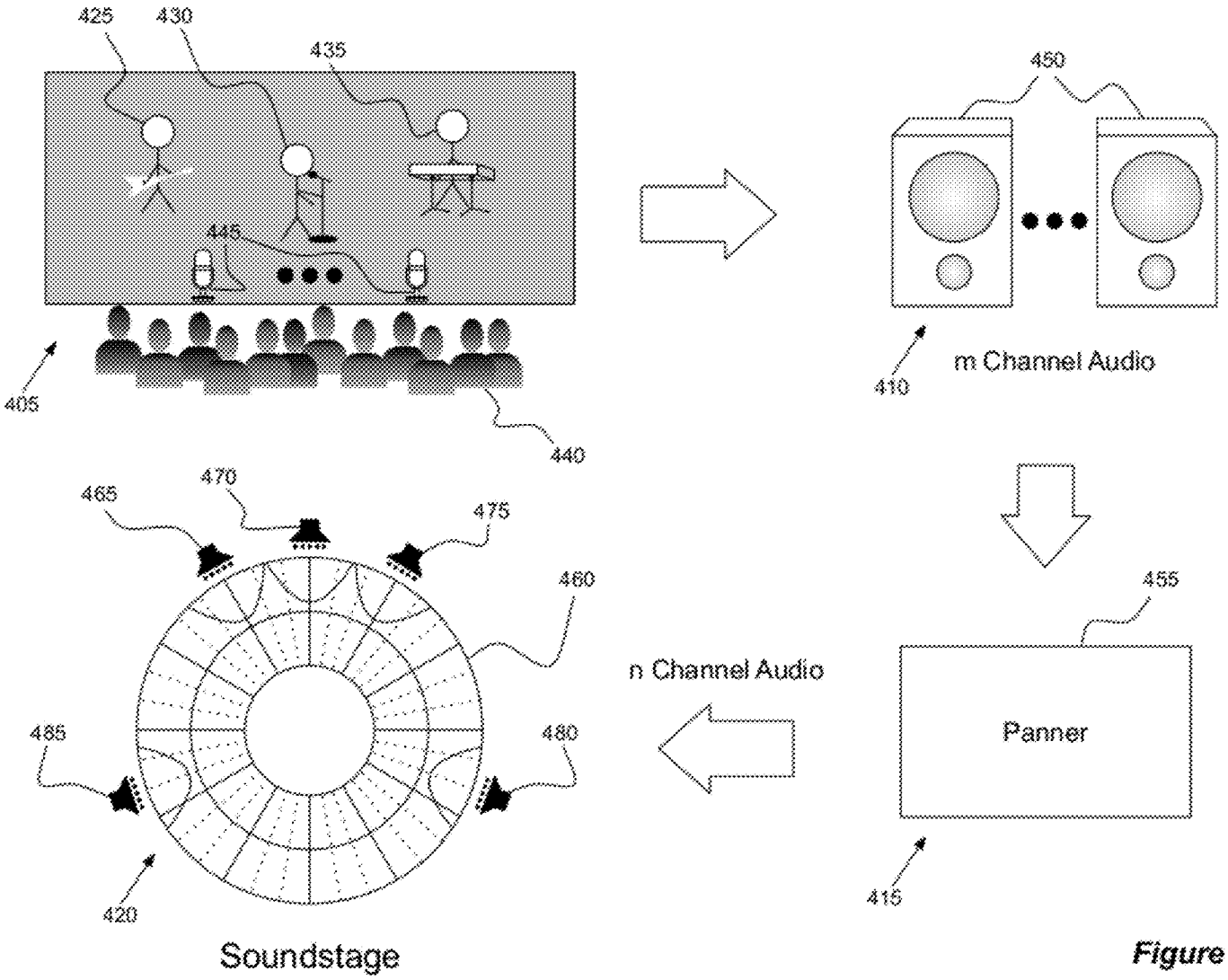
FIG. 4 conceptually illustrates an overview of the recording, decoding, panning and reproduction processes of audio signals in some embodiments.

FIG. 4 conceptually illustrates an example of an event recorded by multiple microphones with m number of channels in some embodiments. The recording is then stored or transmitted (e.g., as a two-channel audio signal). In some embodiments a panner works in conjunction with a surround sound decoder. In these embodiments, the m recorded channels are decoded into n channels, where n is larger than m. In other words, the number of channels is increased after surround decoding (e.g., m=2 and n=5, 7, 9, etc.). In other embodiments, the panner does not utilize surround sound decoding. In these embodiments, m and n are identical. For example, a panning preset applied to a five-channel recording will produce a five-channel pan effect. The signal is subsequently output to a five-channel speaker system to provide a dynamic sound field for an audience.

The audio recording and processing in this figure are shown in four different stages 405-420. In this example, the first stage 405 shows a live event being recorded by multiple microphones 445. The event being recorded includes three performers—a guitarist 425, a vocalist 430, and a keyboardist 435—playing music before an audience 440 in a concert hall. The predominant sources of audio in this example are provided by the vocalist(s) and the instruments being played. Ambient sound is also picked up by the multiple microphones 445. Sources of the ambient sound include crowd noise from the audience 440 as well as reverberations and echoes that bounce off objects and walls within the concert hall.

The second stage 410 conceptually illustrates a multi-channel reproduction (e.g., m channels in this example) of the multi-channel recording of the event. In a multi-channel system, asymmetric output of audio channels to several discrete speakers 450 are used to create the impression of sound heard from various directions. The asymmetric output of the audio channels represents the asymmetric recording captured by the multiple microphones 445 during the event. Without further processing of the multi-channel recording (to simulate additional channels and effects), multi-channel playback through a multi-speaker system (e.g., two-channel playback in a two-speaker system) will provide the most comprehensive reproduction of the recorded event.

In order to further enhance the audio experience, a panning effect is applied to the recorded audio signal in the third stage 415. The panner 455 applies a user selected panning preset to the multi-channel audio signal in some embodiments. Applying a panning preset involves adjusting audio parameters of the audio signal as a function of time to alter the symmetry and quality of the multi-channel signal. For example, a user can pan a music source across the front of the sound field by selecting a Rotation preset to be applied to a decoded media clip. The Rotation preset adjusts the sets of audio parameters to modulate the individual outputs to each channel of the multi-channel speaker system over time to produce a sense of movement in the reproduced sound.

The fourth stage 420 conceptually illustrates the sound field 460 as represented by the user interface (UI) of the media-editing application. The sound field shows the representative positions of the speakers in a five-channel system. The speakers include a left front channel 465, a right front channel 475, a center channel 470, a left surround channel 485 and a right surround channel 480. While this stage illustrates audio being output equally by all the channels, each channel is capable of operating independently of the remaining channels. Thus, applying panning presets to modify the sets of audio parameters of an audio signal over time produces a specified effect. Several illustrative examples of the effects and graphical UI representations of the effects are shown in detail by reference to FIGS. 9 and 16 below.

E. Keyframe Editing

Figure 5:
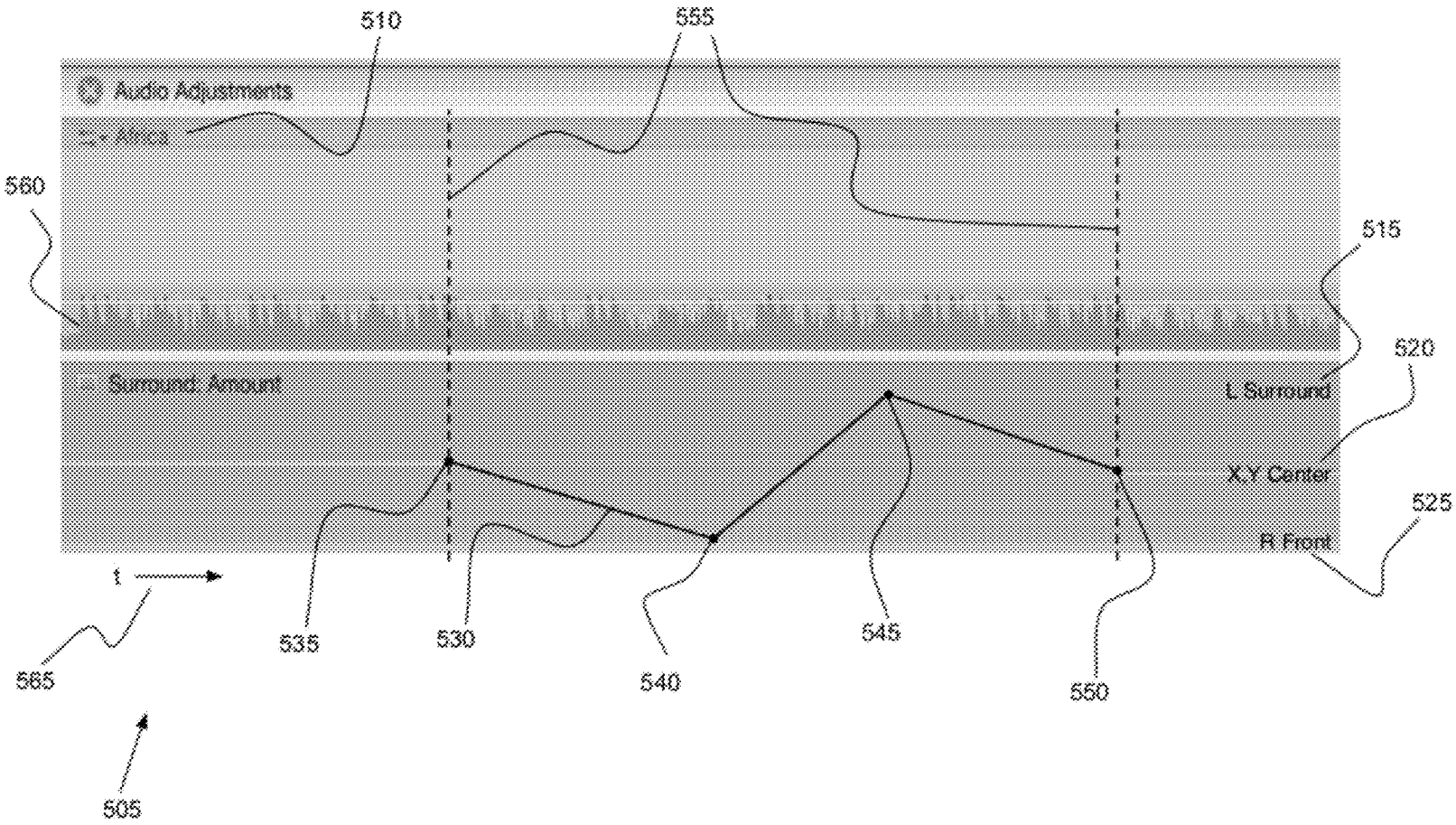
FIG. 5 conceptually illustrates a keyframe editor used to create panning effects in some embodiments.

Keyframes are useful for editing sound output of media clips in certain situations. Traditionally, keyframes have been utilized in making low-level adjustments to different audio parameters. FIG. 5, however, conceptually illustrates a keyframe editor 505 that has been adapted to be used in applying more complex behaviors of sound (i.e., non-linear sound paths, qualitative sound effects, etc.) to media clips. In this example, the editor for applying a "Fly: Left Surround to Right Front" panning preset is provided. The keyframe editor provides an audio track identifier 510 which displays the name of the media clip being edited. The keyframe editor also provides a graphical representation of the audio signal 560 of the media clip. Additionally, the keyframe editor labels the states of the panning position along the Y-axis at the right hand side of the graph. In this example, the three states represented in the keyframe editor are L Surround 515, X,Y Center 520, and R Front 525. The X,Y Center represents the exact center location of a sound field.

The location in the sound field to which the audio is panned during the clip is represented by a graph 530. At a first state 535, the keyframe editor shows the audio panned to the center of the sound field at the start of the media clip. As the media clip progresses down the timeline 565, the keyframe editor shows that the sound is panned from the center of the sound field to the right front, as indicated by the second state 540. Between the second state 540 and the third state 545, the graph 530 on the keyframe editor indicates that the sound is panned from the right front to the left rear (i.e., left surround) of the sound field. At the fourth state 550, the sound is panned back to the center of the sound field.

The keyframe editor further shows user markers 555 placed by a user to indicate the start and end of a segment of the media clip that the user chooses to apply the panning effect. These markers may also be used in conjunction with a panning preset to provide a start point and an end point to facilitate scaling of the panning preset to the indicated segment. For example, if the user would like to apply a Fly: Left Surround to Right Front panning preset to only a portion of the media clip, the user drops markers on the media clip indicating the beginning and end points of the segment to which the user would like the panning preset to be applied. Without setting beginning and end markers, the media-editing apparatus applies the panning preset over the duration of the entire clip by default.

While FIG. 5 shows that keyframe editors can be used to apply more simplistic panning behaviors, keyframe editors are not able to easily apply more elaborate panning behaviors to a media clip. For example, a user would not be able to keyframe a twirl behavior (e.g., sound rotating around a sound field and drifting progressively farther away from the center of the sound field) of sound through a keyframe editor without a lot of difficulty. By providing a panning preset or allowing a user to author a panning preset that applies such a behavior to a media clip, the user avoids having to produce such complex behavior in a keyframe editor.

With panning presets, the user is able to choose high-level behaviors to be applied to a media clip without having to get involved with the low level complexities of producing such effects. Furthermore, panning presets are made available to be applied to a variety of different media clips by simply selecting the preset in the UI. While the keyframe editor might still be utilized to indicate the start and end of a segment to be processed, panning presets eliminates the need to use keyframe editing for most other functionalities.

F. Selection of Panning Presets

Figure 6:
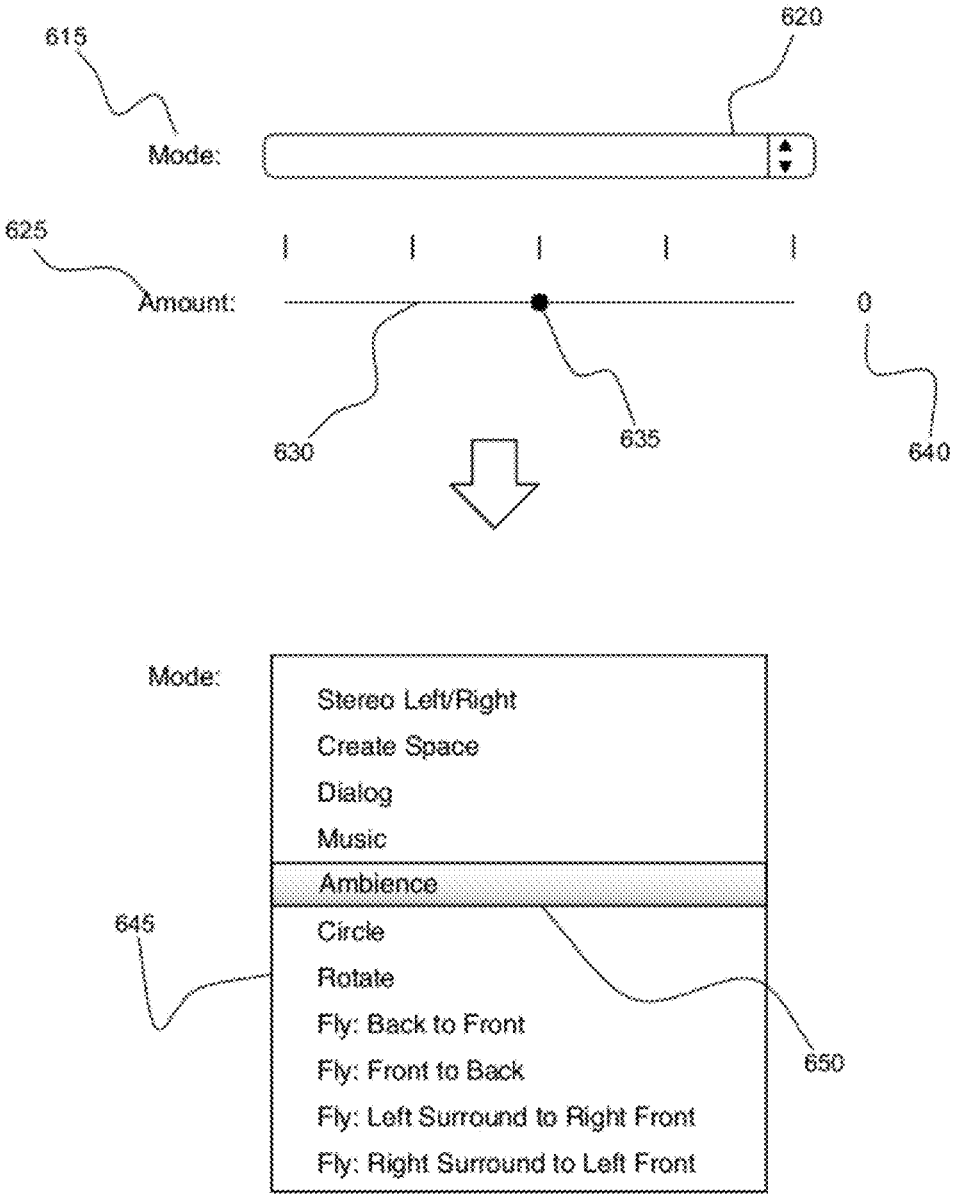
FIG. 6 conceptually illustrates a user interface for selecting a panning preset in some embodiments.

FIG. 6 conceptually illustrates a user interface (UI) for selecting a panning preset in some embodiments. In some embodiments, the UI for selecting the panning preset is part of the GUI described by reference to FIGS. 9, 16 and 22. In some embodiments, the UI for selecting the panning preset is a pop-up menu. The UI 605 includes a Mode (also referred to as Pan Mode) setting 615 and an Amount (also referred to as Pan Amount) setting 625. Initially, there is no value associated to the Mode setting 615 of the UI in the Mode selection box 620 since no panning preset has been selected. Furthermore, the Amount value, which is numerically represented in the Amount value box 640 and graphically represented by a slider control 635 on a slider track 630 is not functional until a panning preset has been selected.

The user selects a panning preset from e.g., a drop-down list 645 of panning presets. In this figure, the user selects the "Ambience" panning preset 650, which is subsequently highlighted. Upon selection of a panning preset, the Amount value is set to a default value (e.g., the amount value is set to 50.0 here).

G. Application of Panning Presets

Figure 7:
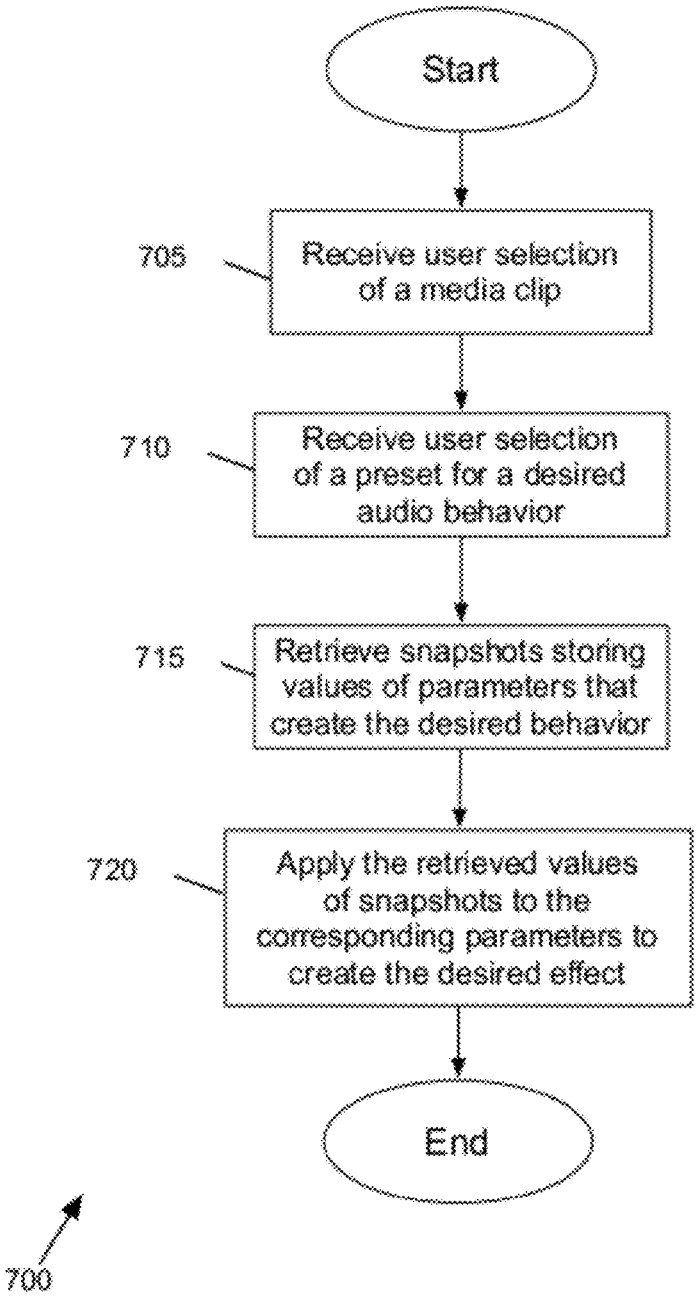
FIG. 7 conceptually illustrates a process for selecting a panning preset in some embodiments.

FIG. 7 conceptually illustrates a process 700 for applying a panning preset in some embodiments. As shown, process 700 receives (at 705) a user selection of a media clip to be processed. Next, process 700 receives (at 710) a user selection of a panning preset from a list of several selectable presets. Each selectable panning preset produces a different audio behavior when applied to a media clip. Once the user has selected the panning preset with the desired audio effect, process 700 retrieves (at 715) snapshots storing values of audio parameters that create the desired behavior. Each snapshot is a predefined set of parameter values that represent different states of a panning preset.

After retrieving the snapshots, process 700 applies (at 720) the retrieved values of each snapshot to the corresponding parameters of an audio clip at different instance in time to create the desired effect. In some embodiments, the predefined sets of parameter values are displayed successively in UI as the user scrolls through the different states of the selected panning preset. After the sets of parameter values are displayed, the process ends.

H. Panning Preset Outputs

Figure 8:
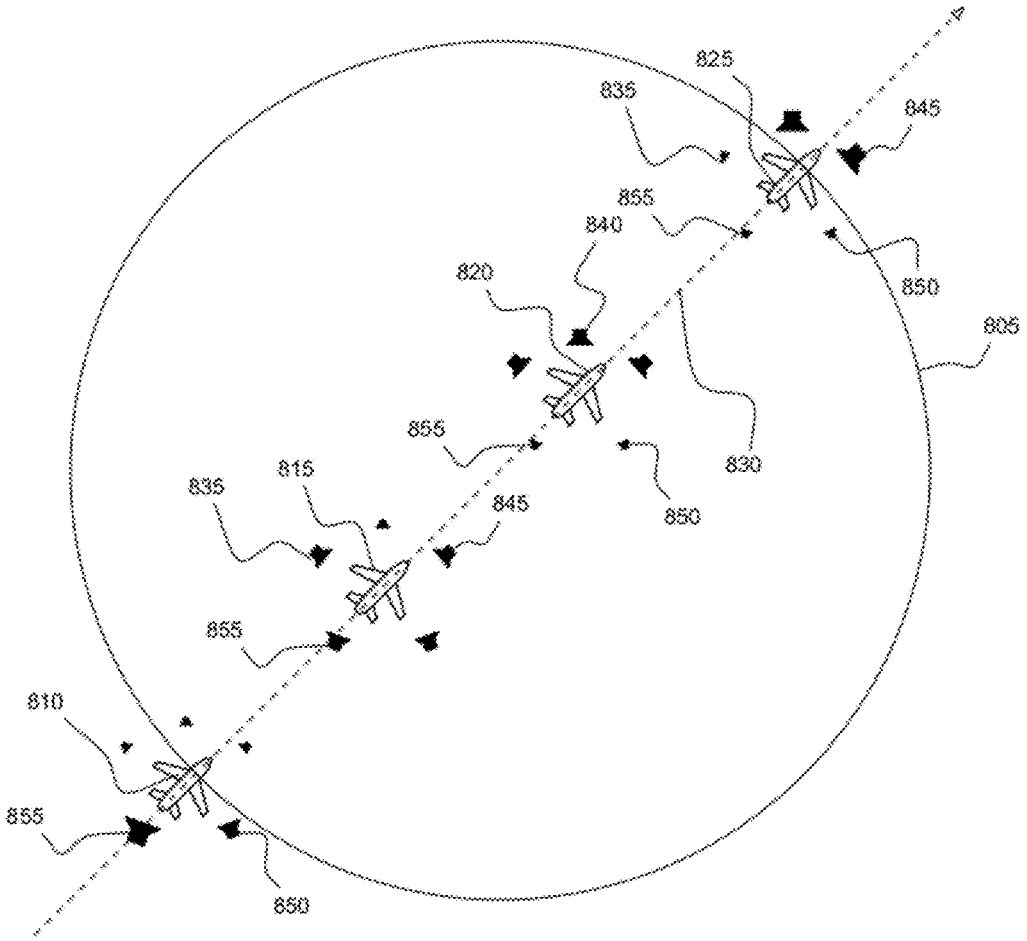
FIG. 8 conceptually illustrates a panning preset output to multi-channel speakers in some embodiments.

FIG. 8 conceptually illustrates the output, in some embodiments, of the multi-channel speaker system during four separate steps 810-825 of a panning preset in a sound field 805. The panning preset applied by the media-editing application in this example is a "Fly: Left Surround to Right Front" preset. In this figure, the sound of an airplane is shown as being panned along a particular path 830, and the output amplitudes of each of the speakers 835-855 is represented by the size of the speaker in this example.

In the first step 810, the airplane is shown to be approaching from the left rear of the sound field. As the airplane approaches from this direction, the audio signal is being output predominantly by the left surround channel 855 with some audio being output by the right surround channel 850 to provide some ambience in the airplane sound. Outputting audio primarily from the left surround creates the sense that the airplane is approaching from the left rear of the sound field 805.

As the airplane approaches the middle of the sound field 805 in the second step 815, the amplitude of left surround channel 855 is attenuated slightly while the amplitude of the left front 835 and right front channels 845 are amplified. This effect creates the sense that while the airplane is still approaching from the rear, that it is nearing a position directly in the middle of the sound field 805.

At the third step 820, the airplane has passed overhead and continues to fly in the direction of the right front channel. Accordingly, the amplitude of the left surround 855 and right surround 850 channels continue to attenuate while the amplitude of the center channel 840 is amplified to produce the effect that the airplane is now moving towards the front of the sound field. To produce the effect that the airplane continues to fly towards the right front of the sound field 805, the amplitude of the left front 835 and the two surround 850, 855 channels are progressively attenuated while the right front channel 845 becomes the predominant audio channel via amplification as shown in the fourth step 825.

The modulation of each audio channel in FIG. 8 provides an overview of how altering the amplitudes of the output signals produces a desired panning effect. The details of how the UI depicts the modulations of the audio channels and adjusts the relevant audio parameters are discussed in greater detail by reference to FIG. 9.

I. User Interface Depiction of Panning Preset

Figure 9:
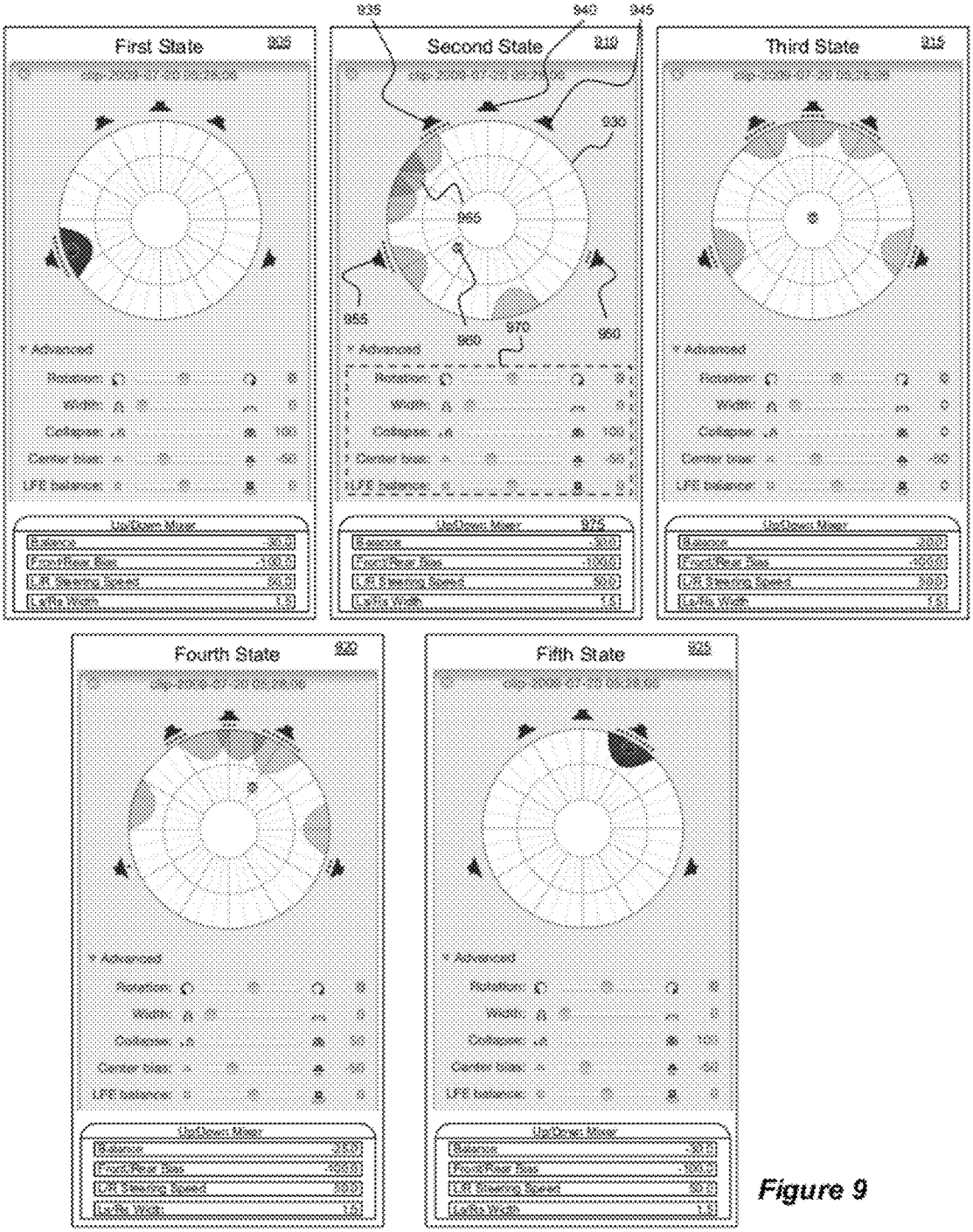
FIG. 9 conceptually illustrates a user interface depictions of different states of a "Fly: Left Surround to Right Front" preset in some embodiments.

FIG. 9 conceptually illustrates five states 905-925 of a UI for a "Fly: Left Surround to Right Front" preset in some embodiments. The UI provides a graphical representation of a sound field 930 that includes a five-channel surround system. The five-channels comprise a left front channel 935, a center channel 940, a right front channel 945, a right surround channel 950, and a left surround channel 955. The UI further includes shaded mounds (or visual elements) 965 within the sound field 930 that represents each of the five source channel. In this example, shaded mound 965 represents the center source channel, and each additional mound going in a counter-clockwise direction represents the left front, the left surround, the right surround, and the right front channels, respectively. The UI also includes a puck 960 that indicates the manipulation of an input audio signal relative to the output speakers. When a panning preset is applied to pan an audio clip in a particular direction or along a predefined path, the movement of the puck is automated by the media-editing application to reflect the different states of the panning preset. The puck is also user adjustable in some embodiments. Finally, the UI includes display areas for the Advanced Settings 970 and the Up/Down Mixer 975.

Furthermore, as described by reference to FIG. 22 below, this UI is part of a larger graphical interface 2200 of a media editing application in some embodiments. In other embodiments, this UI is used as a part of an audio/visual system. In other embodiments, this UI runs on an electronic device such as a computer (e.g., a desktop computer, personal computer, tablet computer, etc.), a cell phone, a smart phone, a PDA, an audio system, an audio/visual system, etc.

At the first state 905, the puck is located in front of the left surround speaker 955, indicating that the panning preset is manipulating the input audio signals to originate from the left surround speaker. The first state 905 further shows that the multiple channels of the input audio are collapsed and output by the left surround speaker only, thus producing an effect that the source of the audio is off in the distance in the rear left direction.

At the second state 910, the panning preset automatically relocates the puck 960 closer to the center of the sound field 930 to indicate that the source of the audio is approaching the audience. As the source of the audio approaches the middle of the sound field 930, the amplitude of the left surround channel 955 is attenuated while the amplitudes of the right surround 950 and the left front 935 are increased. This effect creates the sense that while the source of the sound is approaching from the rear, the source is nearing a position directly in the middle of the sound field 930.

At the third state 915, the panning preset places the source of the sound directly in the center of the sound field 930 as indicated by the position of the puck 960. In order to produce this effect, the amplitudes of each of the five-channel speakers are adjusted to be identical. The third state 915 further shows that each source channel is being output by its respective output channel (i.e., the center source channel is output by the center speaker, the left front source channel is output by the left front speaker, etc.).

At the fourth state 920, the panning preset continues to move the source of the sound in the direction of the right front channel. This progression is again indicated by the change in the position of the puck 960. At this state, the amplitude of the right front channel is shown as being greater than the remaining channels, and the amplitude of surround channels are shown to have been attenuated, particularly the left surround channel. The panning preset adjusts the audio parameters to reflect these characteristics to produce an effect that the source of the sound has passed the center point of the sound field 930 and is now moving away in the direction of the right front channel.

At the fifth state 925, the puck 960 indicates that the panning preset has manipulated the input audio signal to be output only by the right front channel. Outputting all of the collapsed source channels to just the right front channel produces an effect that the source of the audio is off in the distance in the right front direction.

The five states 905-925 also illustrate how the panning preset automatically adjusts certain non-positional parameters to enhance the audio experience for the audience. During the second through fifth states, the value of the Collapse parameter is manipulated by the panning preset. Altering the Collapse parameter relocates the source sound. For example, when a source sound containing ambient noise is collapsed, the ambient noise that's generally output to the rear surround channel is redistributed to the speaker indicated by the position of the puck 960. In the first state 905, the left surround channel outputs the collapsed audio signal, and after fifth state 925, the right front channel outputs the collapsed audio signal.

Furthermore, the second through fifth states also indicate an adjustment to the Balance made by the panning preset. The Balance parameter is used to adjust the mix of decoded and undecoded audio signals. The lower the Balance value, the more the output signal comprises undecoded original audio. The higher the Balance value, the more the output signal comprises decoded surround audio. The example in FIG. 9 shows that the third state 915 and the fourth state 920 utilize more decoded audio signal than the other three states because the third state 915 and the fourth state 920 require the greatest separation of source channels to be provided to the output channels. The third state 915 in particular illustrates that each speaker channel is outputting an audio signal from its respective source channel.

FIG. 9 illustrates only five states of the application of a panning preset. The actual application of panning presets, however, requires the determination of audio parameters for all states along the panning path. The audio parameters for the additional states are determined based on interpolation functions, which is discussed in further details by reference to FIG. 10 below.

II. Authoring Panning Presets

A. Creating Snapshots for Panning Presets

Figure 10:
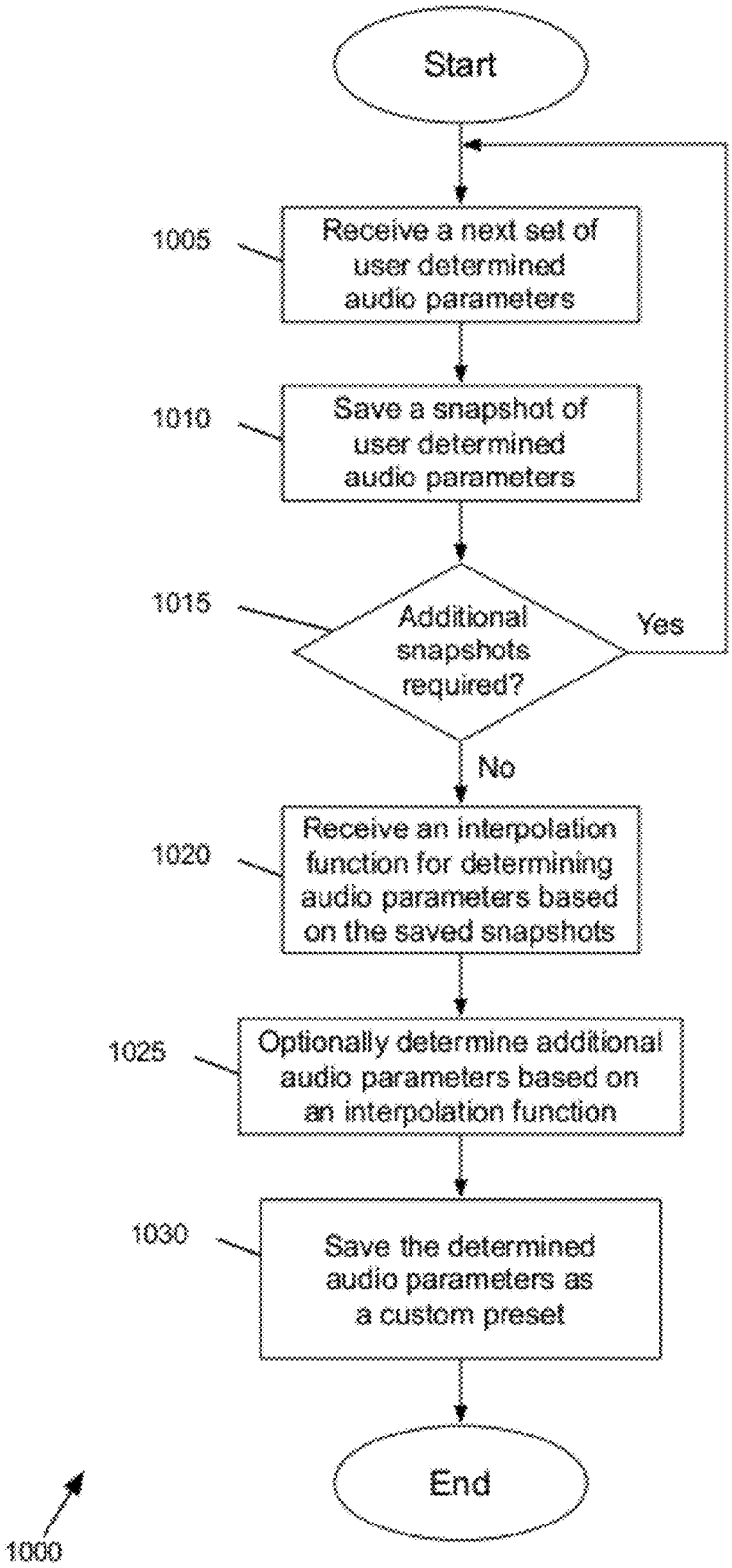
FIG. 10 conceptually illustrates a process for creating snapshots of audio parameters for a preset in some embodiments FIG. 11 conceptually illustrates the values of user-determined snapshots for different audio parameter in some embodiments.

FIG. 10 conceptually illustrates a process 1000 for creating snapshots of audio parameters for a preset in some embodiments. As shown in the figure, process 1000 receives (at 1005) a next set of user determined audio parameters. A user specifies each audio parameter by assigning a numerical value to each parameter to represent a desired effect for an instance in time. Once the user has assigned a value to each of the audio parameters in a first instance, the values are saved (at 1010) as a next snapshot.

After saving a snapshot, the process determines (at 1015) whether additional snapshots are required to perform an interpolation. When additional snapshots are required, process 1000 returns to 1005 to receive a next set of user determined audio parameter values. The user assigns a numerical value to each parameter to represent a desired effect for another instance in time. The values are then saved (at 1010) as a next snapshot.

When a required number of snapshots have been saved, the process receives (at 1020) an interpolation function for determining interdependent audio parameters based on the saved snapshots. With the interpolation function, process 1000 optionally determines (at 1025) additional sets of audio parameters based on the saved snapshots in some embodiments. The additional interpolated sets of audio parameters are subsequently saved along with the saved snapshots (at 1030) as a custom preset.

Figure 11:
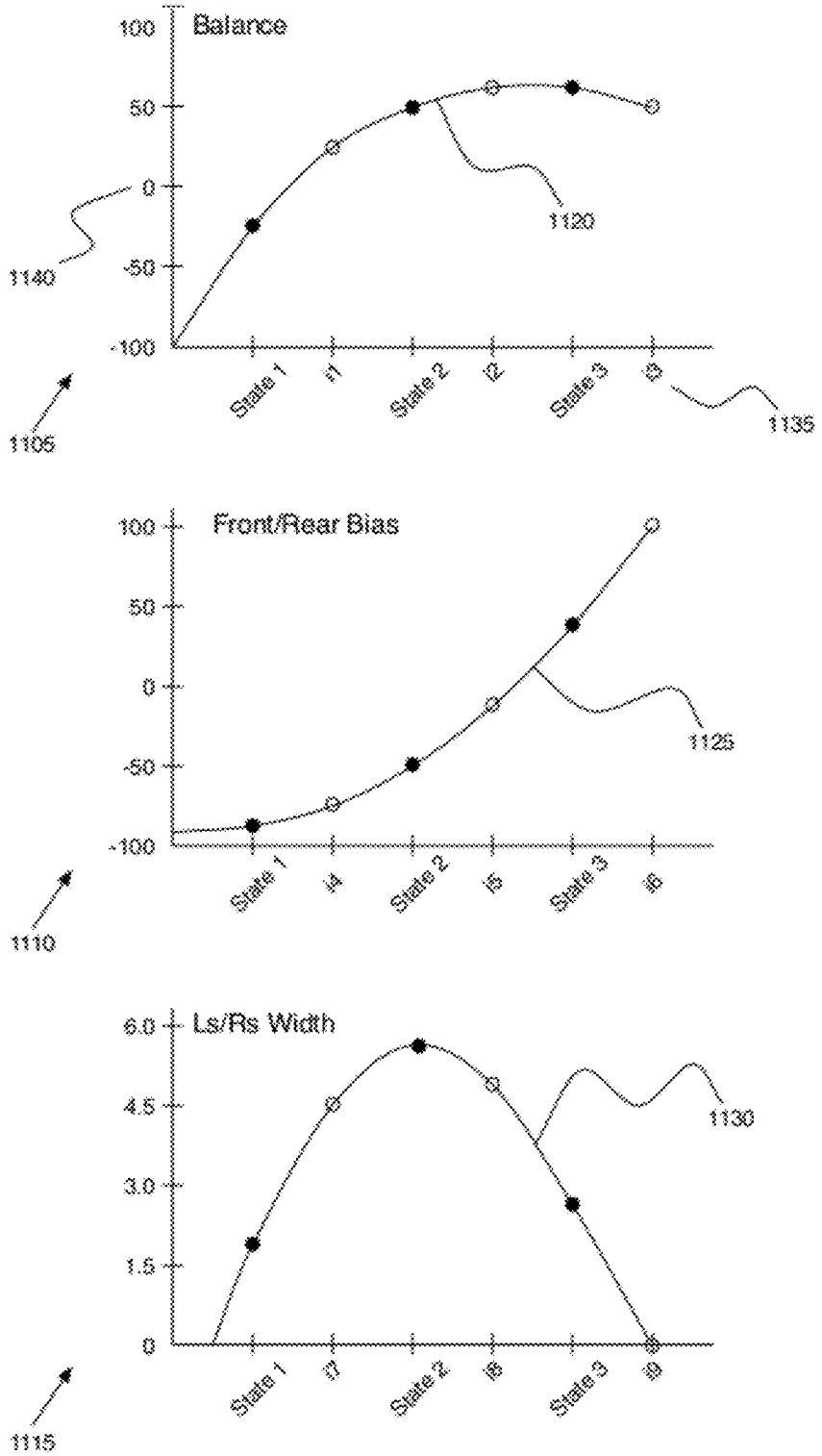

FIG. 11 conceptually illustrates the values of snapshots for different audio parameter in some embodiments. The three audio parameters shown in this example include Balance, Front/Rear Bias, and Ls/Rs Width. For purpose of explanation, a combination of three audio parameter components is used to produce a desired audio effect in this example. One of ordinary skill in the art will recognize that creating audio effects may require modulation of several additional audio parameters.

As described above by reference to FIG. 10, the snapshots of audio parameters represent a desired effect for an instance in time. Here, snapshots are produced at three instances in time (e.g., State 1, State 2, and State 3). The first graph 1105 plots Balance values extracted from the snapshots in each of the three instances; the second graph 1110 plots Front/Rear Bias values extracted from the snapshots in each of the three instances; and the third graph 1115 plots Ls/Rs Width values extracted from the snapshots in each of the three instances.

The combination of parameter values represented by each snapshot produces a desired audio effect for an instance in time. In this example, each snapshot is broken down into three separate parameter components so that a different interpolation function may be determined for each of the different parameter graphs.

The first graph 1105 shows Balance values for each of the three snapshots. The first graph 1105 further shows a first curve 1120 that graphically represents an interpolation function on which interpolated Balance values lie (e.g., i1, i2, and i3). The second graph 1110 shows Front/Rear Bias values for each of the three snapshots. The second graph 1110 also includes a second curve 1125 that graphically represents an interpolation function on which interpolated Front/Rear Bias values lie (e.g., i4, i5, and i6). Similarly, a third curve 1125 of the third graph 1115 represents an interpolation function on which interpolated Ls/Rs Width values (e.g., i7, i8, and i9) lie. The Ls/Rs Width values for each of the tree snapshots also lie on the third curve 1130.

Having determined an interpolation function for each of the three parameters, the media-editing application may interpolate values at run time to be applied to media clips in order to produce the desired effect. In other words, for each value along the X-axis, there exist a parameter value for each of the three Y-axes that form a snapshot of parameter values that produce a desired effect for an instance in time. Thus, successive application of these snapshots to a media clip will produce the desired audio behavior.

This example shows values interpolated by using linear mathematical curves for purpose of explanation; however, one of ordinary skill in the art will recognize that more elaborate interpolation functions may be used. In some embodiments, non-linear mathematical functions (i.e., sine wave function, etc.) are utilized as the interpolation function. After the sets of user defined parameter values have been determined, they are and saved as a preset. Once saved, the preset is made available for use by the user at a later time.

III. Application Of Panning Presets

A. Dynamic Panning Presets

Figure 12:
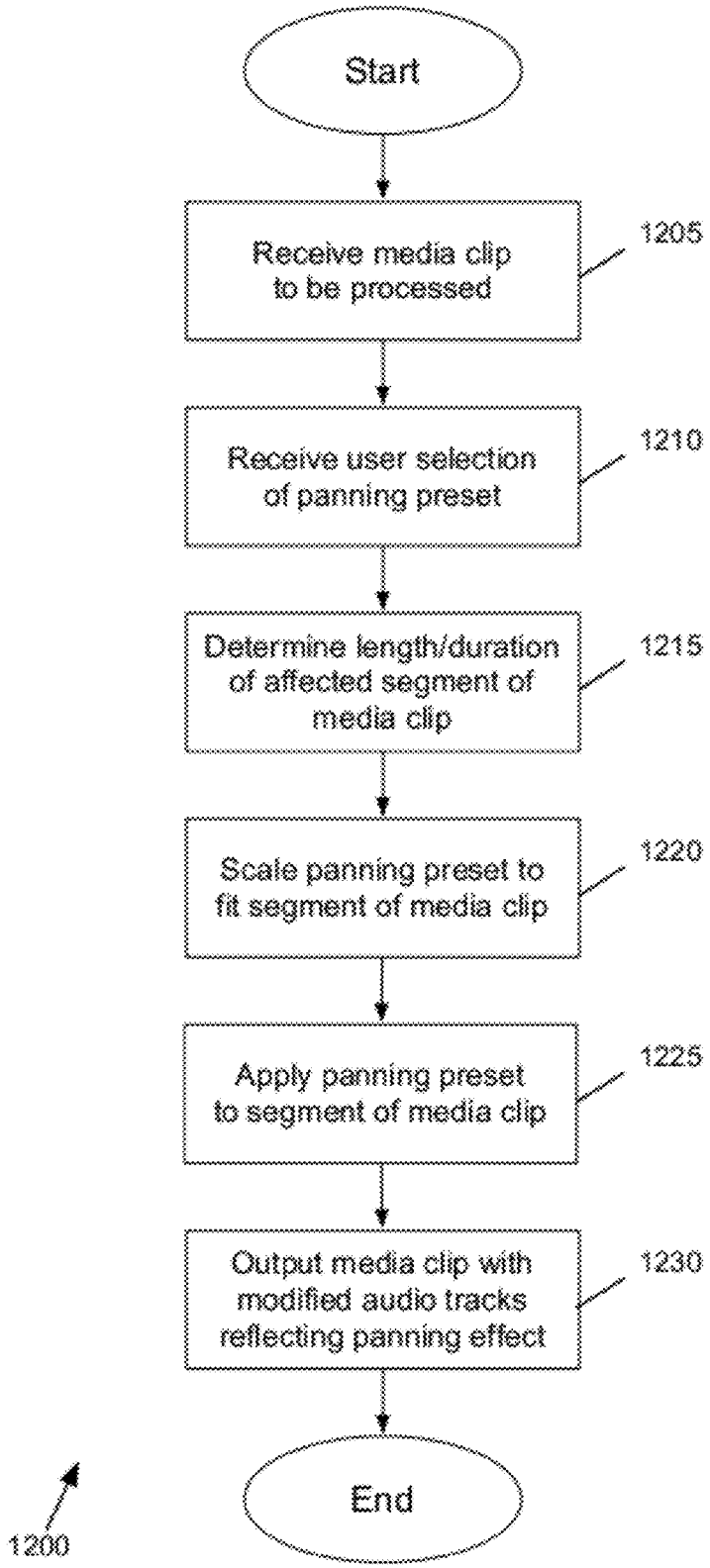
FIG. 12 conceptually illustrates a process of applying a panning preset to a segment of a media clip in some embodiments.

FIG. 12 conceptually illustrates a process 1200 for dynamically applying a saved panning preset to a segment of a media clip in some embodiments. As shown, process 1200 receives (at 1205) a media clip to be processed. The media clip is received through a user selection of a media clip that the user would like to process with the panning preset. Next, the process receives (at 1210) a selection of a panning preset (e.g., selecting the panning preset from a drop down box) in some embodiments. The preset from which the user selects includes standard presets that are provided with the media-editing application or customized presets authored by the user or shared by other users of the media-editing application.

After the media clip and the panning preset selections are received, the process determines (at 1215) the length/duration of a segment of the media clip to which the selected preset is applied. In some embodiments, the length/duration of the segment is indicated by user markers placed by the user on the media clip track in the UI. However, if the user does not specify a length, the process applies the selected preset to the entire media clip by default. In order to provide proper application of the panning preset, the panning effect of the preset is scaled (at 1220) to fit the length/duration of the selected segment. The panning preset is then applied (at 1225) to the media clip. The step of applying the panning preset to the media clip is described in further detail by reference to FIG. 13 below.

For example, when the "Fly: Left Surround to Right Front" preset is applied to a segment of a longer duration, the effects of the preset are scaled such that the progression of the effect is gradually applied throughout the duration of the segment. For a segment of a shorter duration, the scaling is proportionally applied to the media clip. Since the latter example provides a shorter time frame for which the effect is performed, the progression of the effect occurs at a quicker rate than that of the segment of a longer duration, thus producing the effect that the sound source is moving quicker through the sound filed than the in the former example. Accordingly, the scaling of the preset to the user indicated duration is used in producing different qualities of the same preset effect.

Once the preset is applied, a media clip with modified audio tracks is produced and output (at 1230) by the media-editing application. The process then ends. Upon playback of the output media content, the user is provided an audio experience that reflects the effect intended by the panning preset.

Figure 13:
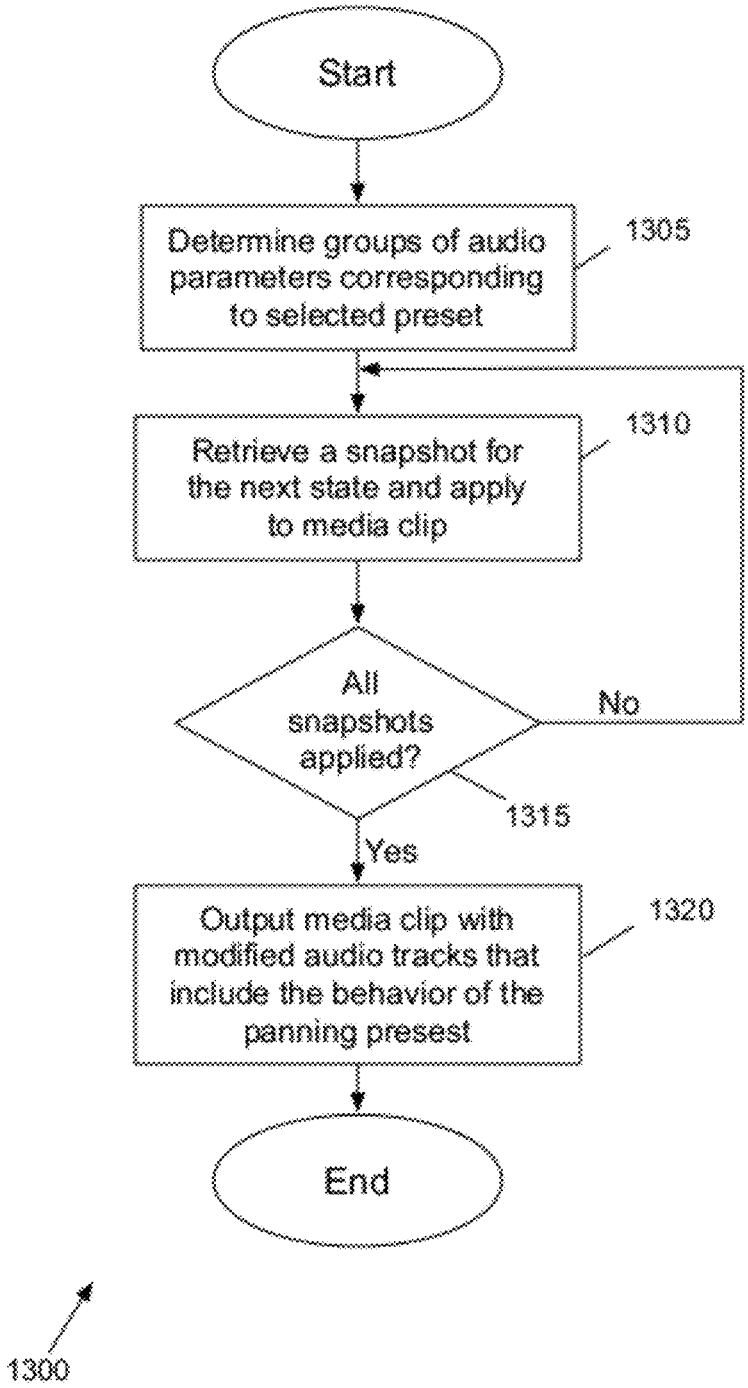
FIG. 13 conceptually illustrates a process of applying different groups of audio parameters to a user specified segment of a media clip in some embodiments.

FIG. 13 provides further details for applying the panning preset to the media clip described at 1225. Specifically, FIG. 13 conceptually illustrates a process 1300 for applying different groups of audio parameters to media clips in some embodiments. The different groups of audio parameters described in this figure are snapshots that represent different states of a panning preset. Each snapshot represents a location along a path of the panning preset. FIG. 9 described above provides an example of five separate states along a panning path, where each next state represents a progression along the panning path.

As shown, process 1300 determines (at 1305) the groups of audio parameters that correspond to the selected panning preset. Each panning preset includes several snapshots storing audio parameters representing different states along a panning path. For example, in the "Fly: Left Surround to Right Front" preset described by reference to FIG. 9 above, each snapshot represents a different position along the path on which the sound source travels. Next, the process retrieves (at 1310) a snapshot for a next state and applies the audio parameter values stored in the snapshot to the media clip. After applying the audio parameter values of the snapshot, process 1300 determines (at 1315) whether all snapshots have been applied. When all snapshots have not been applied, the process returns to 1310 and retrieves a snapshot for a next state and applies the audio parameter values stored in that snapshot to the media clip.

When all snapshots have been applied, process 1300 outputs (at 1320) the media clip with a modified audio track that includes the behavior of the panning preset. After the media clip has been output, process 1300 ends.

B. Static Panning Presets

In certain instances of media editing, a user may choose to apply a static panning preset to create a consistent audio effect throughout a media clip. An example application of a static panning preset is setting a constant ambience level throughout an entire media clip. In this example, a user selects a preset and a value of the preset to be applied throughout the media clip.

Figure 14:
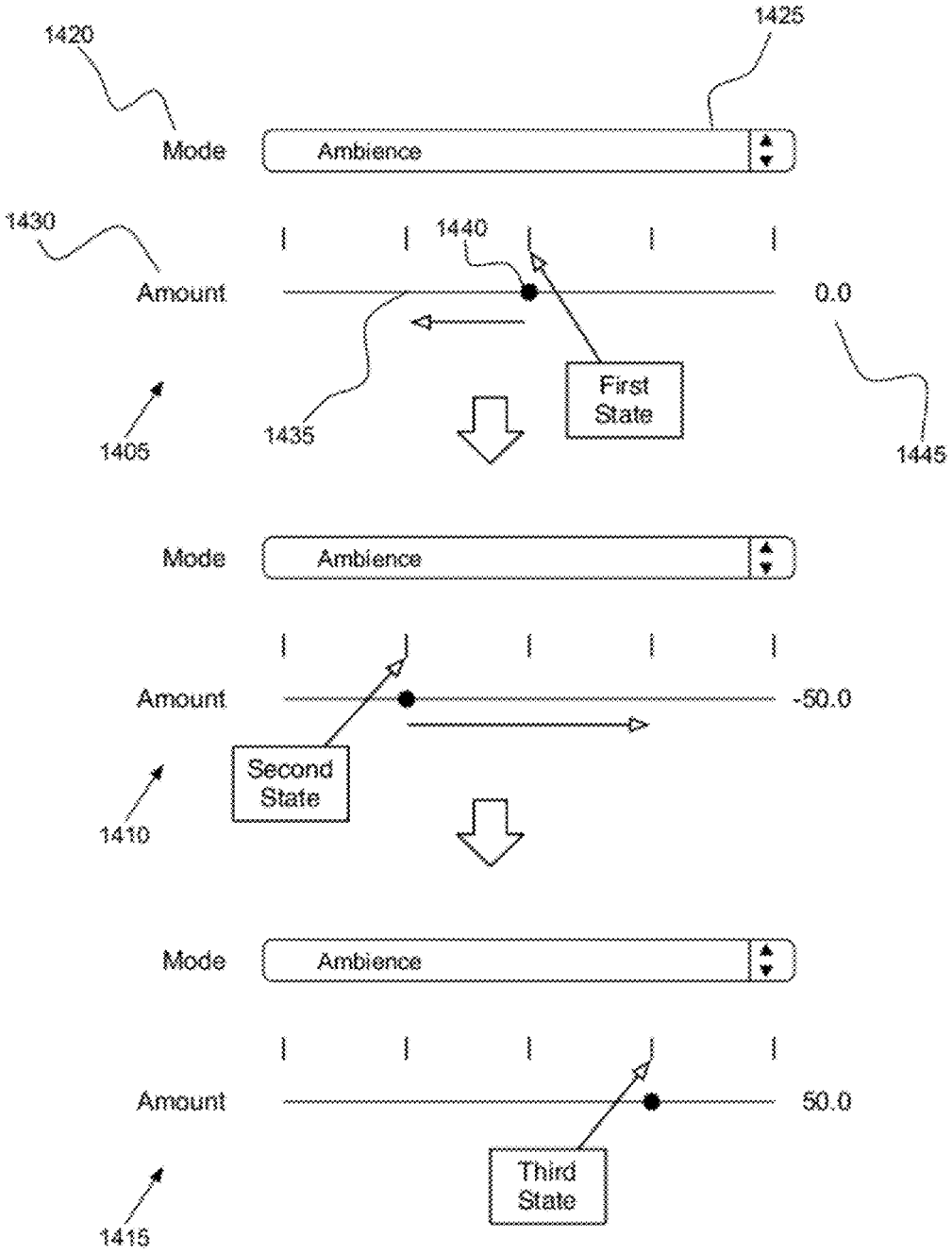
FIG. 14 conceptually illustrates the positioning of a slider control along a slider track representing state values of a panning preset in some embodiments.

FIG. 14 conceptually illustrates a UI from which a user may select a panning preset and a value of the preset to be applied throughout the media clip. In some embodiments, the UI for selecting the panning preset and value of the preset is part of the GUI described by reference to FIGS. 9, 16 and 22. In some embodiments, the UI for selecting the panning preset and value of the preset is a pop-up menu. After the user selects the panning preset, a slider control 1440 and the Amount value box 1445 are enabled in some embodiments. The user may position the slider control 1440 along a slider track 1435 to select a state value of the panning preset. Alternatively, the user may select the state by directly entering a numerical value into the Amount value box 1445 in some embodiments.

The first stage 1405 illustrates that the user has selected the "Ambience" preset, as indicated by the Mode selection box 1425. When the user selects "Ambience", the state value indicated by the Amount value box 1445 is set to a default level (e.g., 0 in this example). This state value is also represented by the position of the slider control 1440 along the slider track 1435. In this example, the range of the slider track 1435 goes from a value of −100 to 100. The slider control 1440 indicates that the Ambience preset is set to a first state represented by an Amount value of 0.0. To change the state value, the user drags the slider control 1440 along the slider track 1435 to a position that represents a desired state value. The numerical value in the Amount value box 1445 automatically changes based to the position of the slider control. Sliding the slider control to the left causes a selection of a lower state value, and sliding the slider control to the right causes a selection of a higher state value. In some embodiments, the user selects the state value by directly entering a numerical value into the Amount value box 1445. When the user inputs a numerical value, the slider control 1440 is repositioned on the slider track 1435 accordingly.

The second stage 1410 indicates that a state with a state value of −50.0 has been selected, as indicated by the numerical value in Amount value box 1445. This state value is also reflected by the position of the slider control 1440 along the slider track 1435. As mentioned above, the states of the panning preset are selected by dragging the slider control 1440 along the slider track 1435 to the desired position to select a desired state value. Upon moving the slider control 1440 to a new position on the slider track 1435, the Amount value 1445 is automatically updated to reflect the state value. If, however, the user selects a state via the Amount value box 1445, the position of the slider control 1440 on the slider track 1435 is automatically updated to reflect the new value.

The third stage 1415 shows the selection of a state having an Amount value of 50.0. The figure shows that the slider control 1440 has moved to a state value of 50.0, which is represented by the three-quarter position of the slider control 1440 along the slider track 1435. The Amount value box 1445, as described above, automatically updates to reflect the numerical value of the state.

The position of the slider control 1440 along a slider track 1435 and the state value displayed in the Amount value box 1445 provide a higher level abstraction of the panning preset effect in some embodiments. In FIG. 14, the user adjusts the amount of the Ambience preset. Each amount value represents a particular state of the preset. Each state is defined as a set of audio parameters that produce a panning effect at the level indicated by the state for that preset.

The Ambience preset is an example preset that a user would choose one state value to be applied throughout the media clip. For example, a user who wishes to have a certain level of ambience applied throughout an entire scene selects the Ambience preset and chooses a state value that provides the level of ambience desired. The media-editing application would subsequently apply the level of Ambience preset indicated by the user throughout the entire clip.

Figure 15:
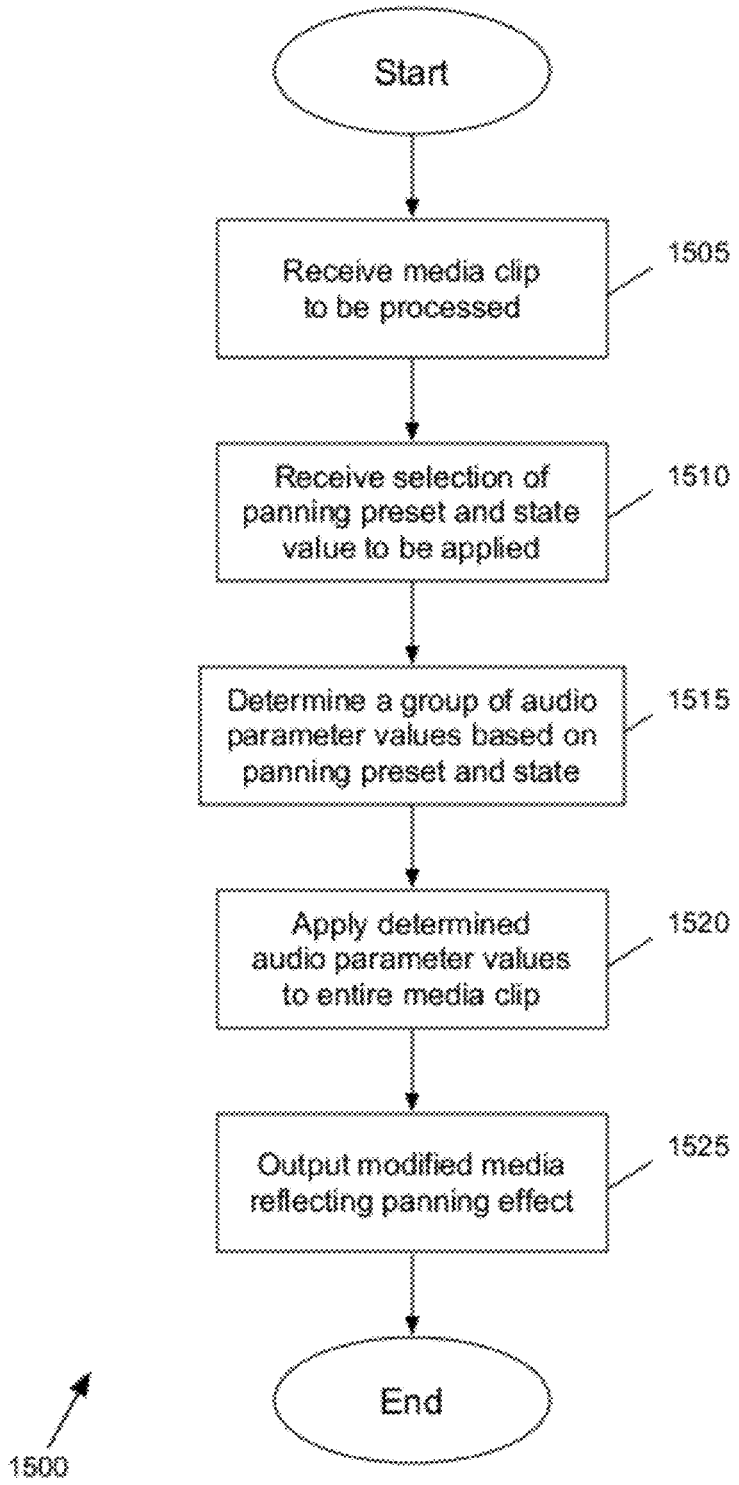
FIG. 15 conceptually illustrates the application of a static panning preset to a media clip in some embodiments.

FIG. 15 conceptually illustrates the application of a static panning preset to a media clip in some embodiments. As shown, process 1500 receives (at 1505) a media clip through a user selection. The selected media clip is one that the user would like to have processed with the panning preset. Next, the process receives (at 1510) a panning preset selection as well as a state value of the panning preset that the user would like to have applied to the media clip. The selection of the panning preset is made from a drop down box in some embodiments. The preset from which the user selects includes standard presets that are provided with the media-editing application or customized presets authored by the user or shared by other users of the media-editing application.

In some embodiments, the state value of the preset is selected by a slider control on a slider track and indicates the amount of the panning preset effect to be applied. For instance, the state value is entered as a quantity (i.e., 0 to 100, −180° to +180°, etc.). The state value of a particular panning preset represents a level of the effect (i.e., levels of ambience, dialog, music, etc.) or location along a path of panning (i.e., positions for circle, rotate, fly patterns, etc.). For example, a state value of −100 in an ambience preset (graphically represented by the slider control of the slider track being at the far left) provides no ambient signals to the rear surround channels. As the state value is increased (graphically represented by the slider control of the slider track moving to the right) more and more ambient noise is decoded from the source and biased to the rear surround channels.

With relation to a circle preset which rotates a source audio in the distance around a sound field, a state value of −180° provides sound from the back of the sound field. As the state value is increased (graphically represented by the slider control of the slider track moving to the right) the source of the audio rotates around the sound field in a clockwise direction. A state value of −90°, 0°, 90° and 180° moves the source audio to the left side of the sound field, front of the sound field, right side of the sound field and behind the sound field, respectively.

After a selection of the panning preset and the state value, process 1500 determines (at 1515) the set of audio parameters that correspond to the selected panning preset at the selected state value. As discussed above, each set of audio parameter values in the panning preset represents a different state of the panning preset. In process 1500, a particular state corresponding to a particular set of parameter values of the panning preset is selected. This particular set of audio parameters determined from the particular state of the preset is applied (at 1520) throughout the selected media clip. After applying the set of audio parameters, the process outputs the modified media reflecting the panning effect. The process then ends.

C. User Interface for Panning Preset

Figure 16:
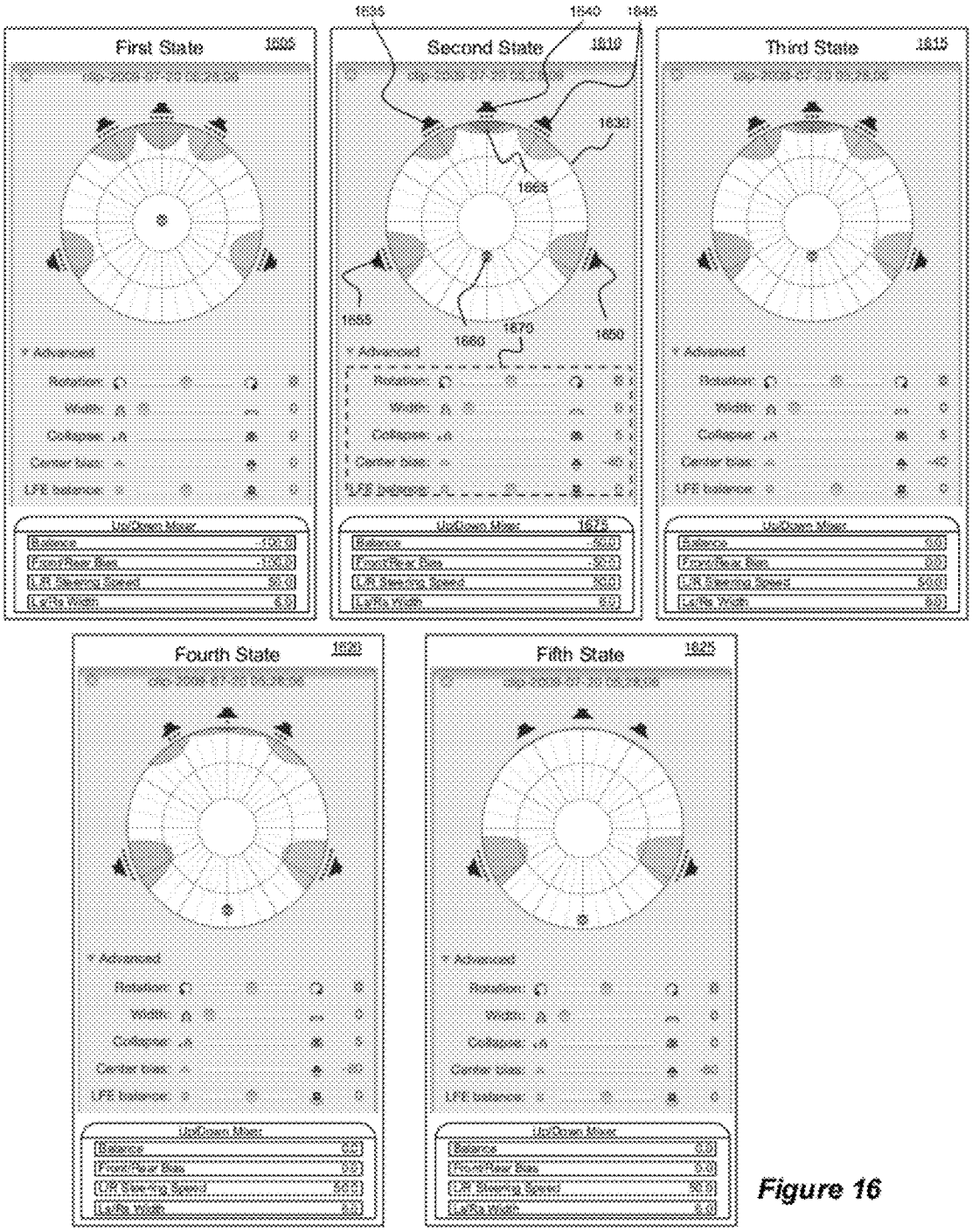
FIG. 16 conceptually illustrates a user interface depicting different states of an "Ambience" preset in some embodiments.

FIG. 16 conceptually illustrates five states of a UI for an "Ambience" preset in some embodiments. The UI provides a graphical representation of a sound field 1630 that includes a five-channel surround system. The five-channels comprise a left front channel 1635, a center channel 1640, a right front channel 1645, a right surround channel 1650, and a left surround channel 1655. The UI further includes shaded mounds 1665 within the sound field 1630 that represents each of the five source channel. In this example, shaded mound 1665 represents the center source channel, and each additional mound going in a counter-clockwise direction represents the left front, the left surround, the right surround, and the right front channels, respectively. The UI also includes a puck 1660 that indicates the manipulation of an input audio signal relative to the output speakers. When a panning preset is applied to pan an audio clip in a particular direction or along a predefined path, the movement of the puck is automated by the media-editing application to reflect the different states of the panning preset. The puck is also user adjustable in some embodiments. Finally, the UI includes display areas for the Advanced Settings 1670 and the Up/Down Mixer 1675.

Furthermore, as described by reference to FIG. 22 below, this UI is part of a larger graphical interface 2200 of a media editing application in some embodiments. In other embodiments, this UI is used as a part of an audio/visual system. In other embodiments, this UI runs on an electronic device such as a computer (e.g., a desktop computer, personal computer, tablet computer, etc.), a cell phone, a smart phone, a PDA, an audio system, an audio/visual system, etc.

The Ambience preset is used to select a level of ambient sound that the user desires. Each of the five states 1605-1625 contain different sets of audio parameters to produce different levels of ambience effect when applied to a medial clip. When a user selects states with progressively more ambience, the Ambience preset biases more and more decoded sound to the surround channels by moving the source from the center channel to the rear surround channels. The Ambience preset produces an effect of sound being all around an audience as opposed to just coming from the front of the sound field.

The first state 1605 of the Ambience preset places the source of the sound directly in the center of the sound field 1630 as indicated by the position of the puck 1660. Each of the five-channel speakers is also shown to have identical amplitudes. At this state, the Ambience preset produces sound all around the audience.

The second state 1610 illustrates a UI representation of an Ambience value that is higher than the first state 1605. As the Ambience value is increased, the Ambience preset starts to introduce ambient sound into the sound field 1630 by utilizing more decoded audio signals that are outputted to the surround channels. This behavior is indicated by both the Balance parameter value and the Front/Rear Bias parameter value being increased to −50 as compared to the first state. The Ambience preset also decreases the Center bias, which reduces the audio signals sent to the center channel and adds those signals to the front left and right channels.

The third state 1615 illustrates a UI representation of an Ambience value that is higher than the second state 1610. Increasing the Ambience value further causes the amount of decoded audio signals used to increase, as indicated by the rise in the Balance parameter value to 0. The increase in the Ambience value also causes the preset to set the Front/Rear Bias to 0, thereby further biasing the audio signals to the rear surround channels.

The fourth state 1620 illustrates a UI representation of an Ambience value that is higher than the third state 1615. To create even more of an ambient effect than the third state, the Ambience preset decreases the Center bias to −80 to further reduce the audio signals sent to the center channel. The audio signals reduced at the center channel are added to the front left and right channels. The fourth state 1620 also shows that the puck has been shifted farther back in the sound field, thus indicating that origination point of the combination of the source channels has been moved towards the back of the sound field 1630.

The fifth state 1625 of the Ambience preset represents the highest level of ambience that a user can select. The fifth state 1625 differs from the fourth state 1620 only by the position of the puck. The puck in the fifth state 1625 is located all the way to the back of the sound field, thus indicating that origination point of the combination of the source channels is at the absolute rear of the sound field 1630. Other than the puck position, the fourth and fifth states have similar audio parameters.

The depiction of the five states in FIG. 16 also demonstrates the intricacies of the producing the different states of the Ambience preset. Without the benefit of an Ambience preset, changing the level of ambience desired would required the user to change several different parameters at the same time. It would also require that the user understands how the audio parameters interact with one another. The task is particularly difficult because the relationships between the audio parameters are non-linear (e.g., not all parameters are moving up/down at the same rate or amount) and are thus very complicated.

Figure 17:
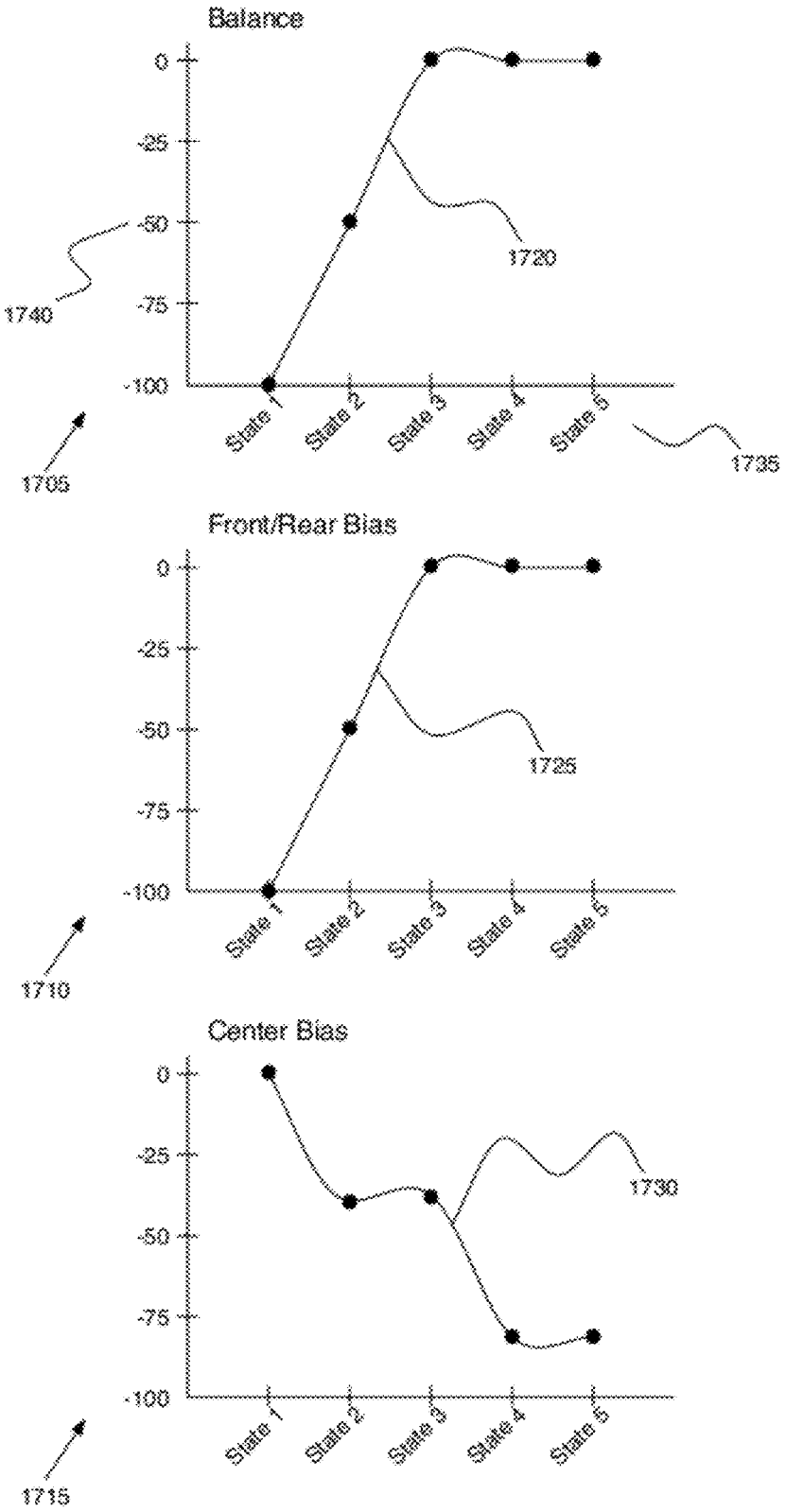
FIG. 17 conceptually illustrates different parameter values of the "Ambience" preset in separate states in some embodiments.

FIG. 17 conceptually illustrates values of different audio parameter of preset snapshots for the Ambience preset in some embodiments. The three audio parameters shown in this example include Balance, Front/Rear Bias, and Center Bias. These three audio parameters represent those that are adjusted by the Ambience preset to produce different levels of ambience.

In this example, Ambience preset includes five instances of snapshots (e.g., State 1, State 2, State 3, State 4, and State 5). Each snapshot represents a different level of ambience effect. The first graph 1705 plots Balance values extracted from the snapshots in each of the five instances; the second graph 1710 plots Front/Rear Bias values extracted from the snapshots in each of the five instances; and the third graph 1715 plots Center Bias values extracted from the snapshots in each of the five instances.

By breaking down each of the snapshots into three separate parameter components and plotting the values for each snapshot, an interpolation function may be determined for each of the different parameter graphs. In other words, plotting the parameter values of each snapshot on their respective parameter graphs provides an illustration as to how the interpolation function may fit in the plot.

The first graph 1705 shows Balance values for each of the five snapshots and a first curve 1720 that connects the values. The second graph 1710 shows Front/Rear Bias values for each of the five snapshots as well as a second curve 1725 that connects the values. Similarly, a third curve 1725 of the third graph 1715 connects each of the five Center Bias values derived from the snapshots. Each of the three curves provides graphical representations of continuous functions that indicate the parameter value for each snapshot as well as for those values on the X-axis in between the snapshots. These curves further represent the parameter values that would be applied to a media clip at runtime when an Ambience preset is selected. Successive application of the values represented by the curve will produce an audio behavior of fading from stereo sound from the front channels to ambient sound from the rear surround channels. A user utilizing the preset to apply to an audio clip is relieved from the task of manually setting each individual value of the parameters in order to achieve the desired audio behavior. While this example of an Ambience preset shows five sets of audio parameters, several additional sets may be predefined and applied to media clips.

D. Interdependence of Parameter Values

Figure 18:
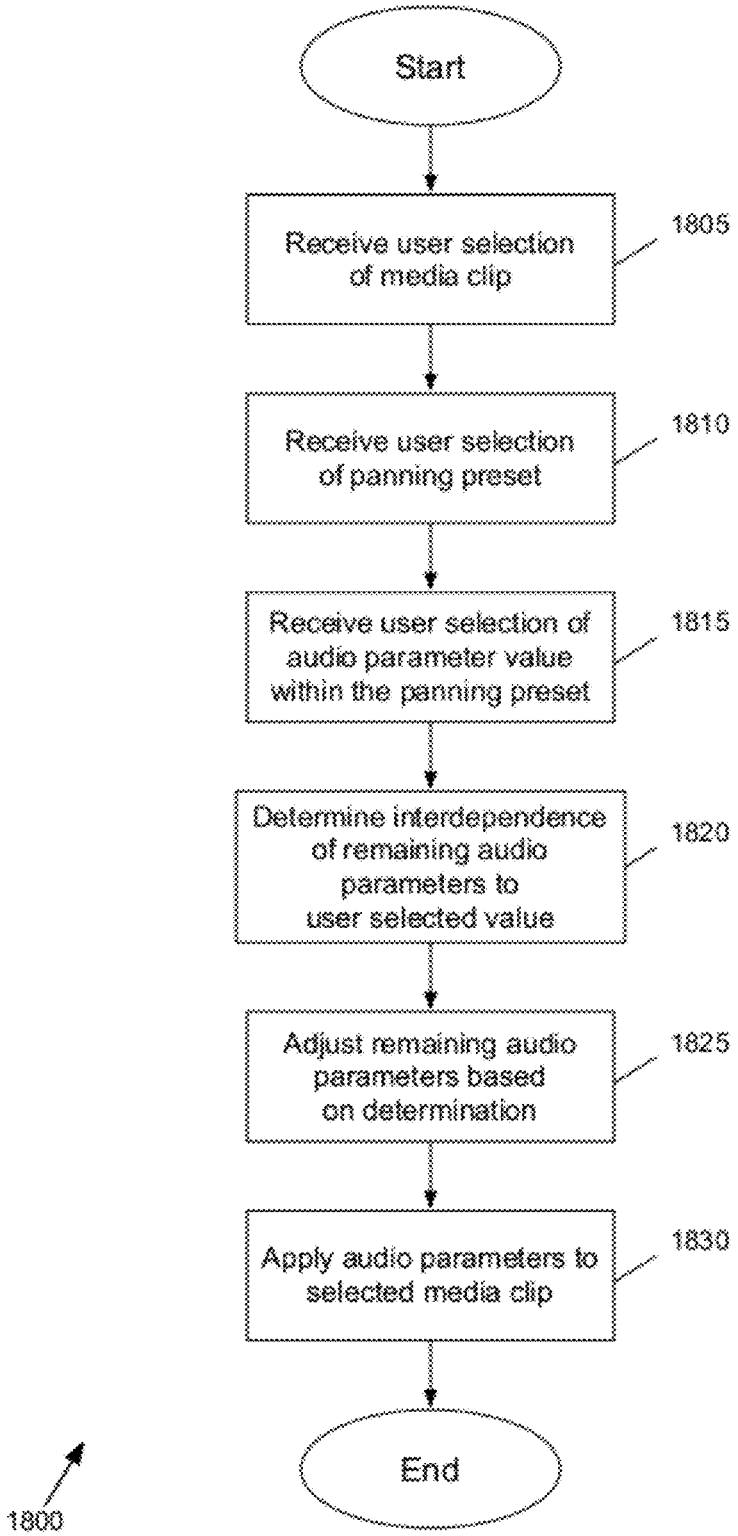
FIG. 18 conceptually illustrates the adjustment of audio parameters in some embodiments.

FIG. 18 conceptually illustrates a process 1800 for adjusting audio parameters within a panning preset in some embodiments. The audio parameters described in this figure represent different audio characteristics to be applied to a media clip. In this example, instead of selecting a particular state of a panning preset by selecting a new state value (thereby causing several audio parameters to be changed), the user selects a new value for a particular audio parameter of the panning preset. By manually selecting a first audio parameter, the user causes one or more additional audio parameters that are interdependent on the first audio parameter to be modified to new values. The combination of the manual selection made by the user with the automatic modification made to the interdependent audio parameters by the panning preset causes the preset to transition from a first state to a second state.

As shown in the figure, process 1800 receives (at 1805) a media clip to be processed (e.g., the user selects the media clip the user would like to process with the panning preset). Next, the process receives (at 1810) a panning preset selection. After selecting the media clip, the user selects the panning preset he wishes to apply to the media clip. This selection is made from a drop down box in some embodiments. The preset from which the user selects includes standard presets that are provided with the media-editing application or customized presets authored by the user or shared by other users of the media-editing application.

Once the selections of the media clip and the panning preset are received, the process receives (at 1815) a user selection of a new value of an audio parameter within the panning preset. The user makes the selection of the audio parameter value by moving a slider control along a slider track to the position of the desired parameter value. In some embodiments, the user selects the parameter value by entering an amount value directly into an amount value box. Since a panning preset selection was received (at 1810), the value for which the user selects for each parameter is constrained to the range of the parameter for the selected preset. For example, the Balance value range of the Ambience preset runs from −100 to 0. Thus, the user would not be permitted to adjust the Balance to a value greater than 0 since that value does not exist in any of the states of the Ambience preset. In some embodiments, selecting an audio parameter value outside of the range specified by the preset causes the media-editing application to exit the selected panning preset.

When a new audio parameter value is selected, the process determines (at 1820) the interdependence of the remaining audio parameters to the user selected parameter value. For a particular preset, different audio parameters have different ranges of values that correspond to a specific state or states of the particular preset. As described above, the Ambience preset has a Balance value that ranges from −100 to 0. Each Balance value within that range has an associated set of parameters whose values are interdependent on the Balance value. For example, if the user selects a Balance value of 0 for the Ambience preset, the process determines from the interdependence of the Front/Rear Bias parameter on the Balance parameter that the Front/Rear Bias must also be set to 0. Process 1800 makes this determination for all audio parameters of the selected preset and adjusts (at 1825) the values of the remaining audio parameters according to the determination. While the example provided above only illustrates the interdependence of one additional audio parameter, several parameters are interdependent on the first parameter in some embodiments. Upon adjusting the remaining audio parameters, the process applies (at 1830) the adjusted audio parameters to the media clip. After the application of the audio parameters, the process ends.

Figure 19:
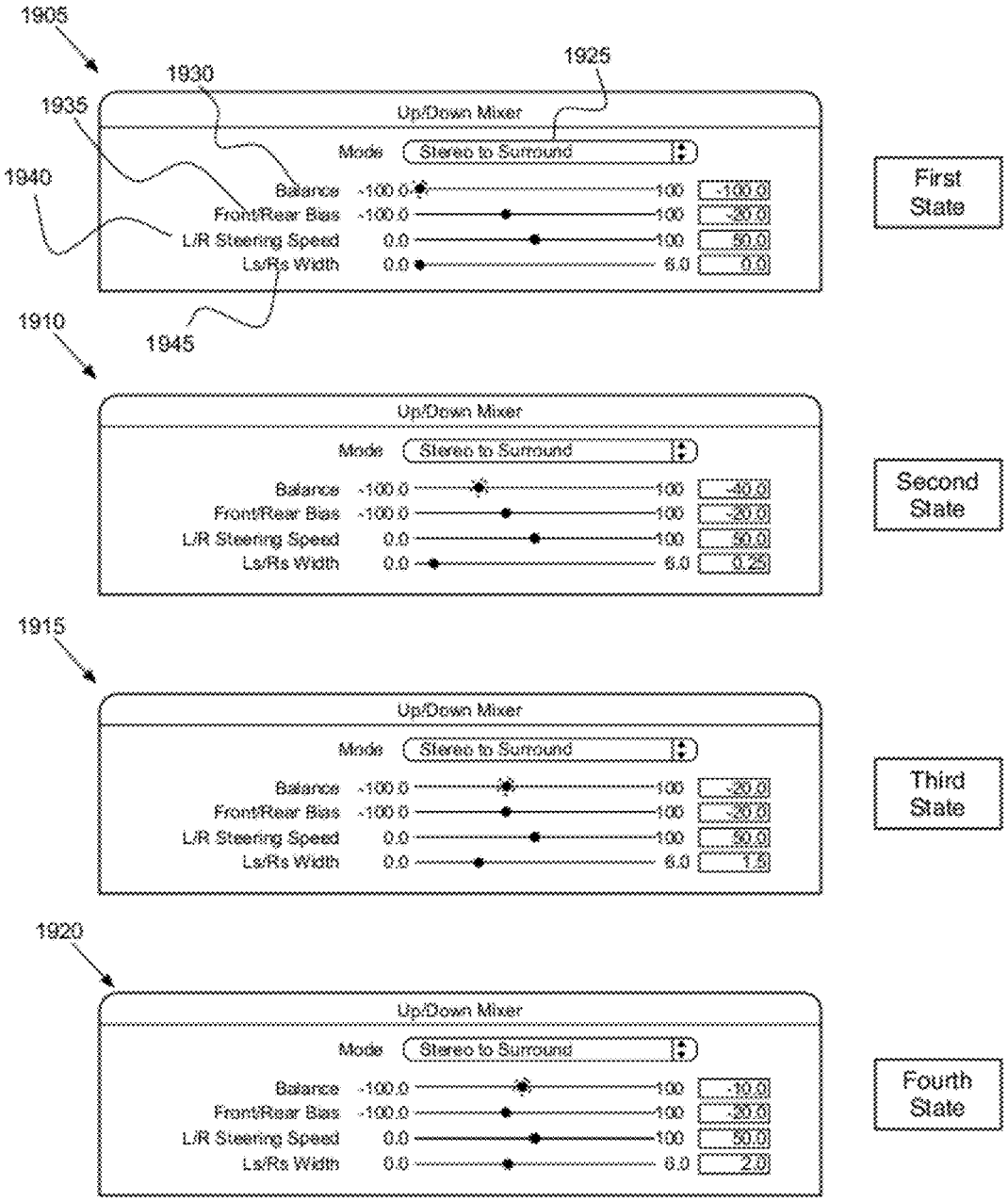
FIG. 19 conceptually illustrates the interdependence of audio parameters for a "Create Space" preset in some embodiments.

FIG. 19 conceptually illustrates the interdependence of audio parameters for a "Create Space" preset. The figure illustrates a UI of an Up/Down Mixer that includes four audio parameters: Balance 1930, Front/Rear Bias 1935, Left/Right (L/R) Steering Speed 1940, and Left Surround/Right Surround (Ls/Rs) Width 1945. In some embodiments, the UI of the Up/Down Mixer is part of the GUI described by reference to FIGS. 9, 16 and 22. In some embodiments, the UI for UI of the Up/Down Mixer is a pop-up menu. The figure further shows a Mode selector 1925 that provides a drop down menu for the user to select a mode. In this example, the UI represent a "Stereo to Surround" upmixing mode. For the Create Space preset, changes in the states of the preset are represented by adjustments to two parameters in the Up/Down Mixer.

At a first state 1905 of the Create Space preset, the Balance value is set at −100, the Front/Rear Bias value is set at −20, the L/R Steering speed is set at 50, and the Ls/Rs Width is set at 0. When a user manually selects a new value for a first parameter of the panning preset, the panning preset adjusts the values of all the parameters within the preset that are interdependent on the first parameter. In this example, the user selects −40 as a new Balance value. In response to the manual selection by the user, the panning preset automatically increases the Ls/Rs Width to 0.25. By adjusting the Ls/Rs Width in response to the user selection, the preset creates a combination of the two parameters that represents a second state 1910 of the Create Space preset.

A third state 1915 shows the user having selected a Balance value of −20. As a new Balance value is again selected by the user, the panning preset causes the Ls/Rs Width value to adjust in response to this new selection. For the Create Space preset, a Balance value of −20 corresponds to a Ls/Rs Width value of 1.5. Similarly, a fourth state 1915 shows the user having selected a Balance value of −10. In response to the selection, the panning preset causes the Ls/Rs Width value to adjust to a Ls/Rs Width value of 2.0.

As discussed above, the preset maintains a relationship between the interdependent parameters so that a selection of a new value to a first parameter causes an automatic adjustment to the values of other interdependent parameters. Each resulting combination of interdependent parameters in this example represents a state of the selected panning preset.

Figure 20:
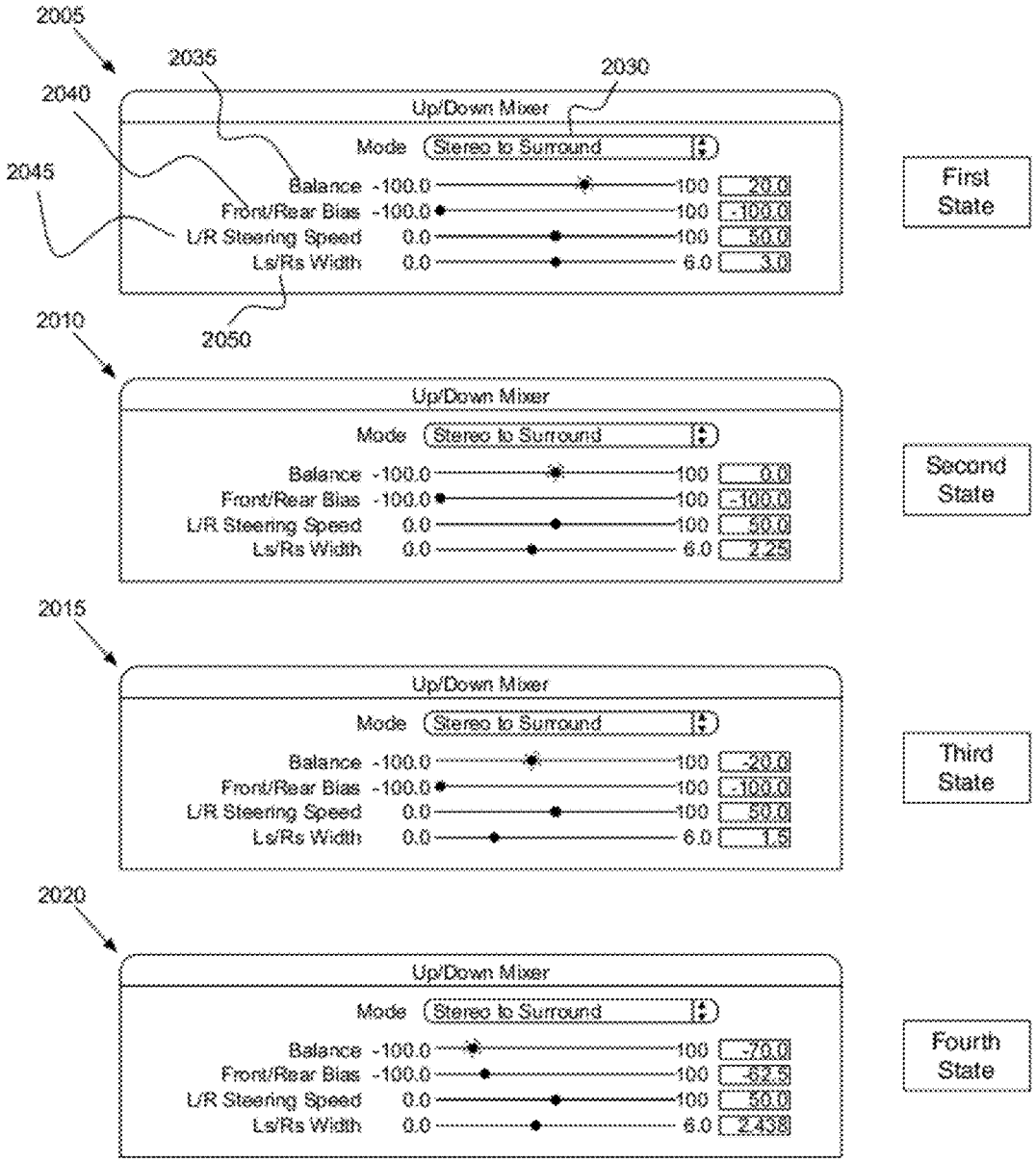
FIG. 20 conceptually illustrates the interdependence of audio parameters for a "Fly: Back to Front" preset in some embodiments.

FIG. 20 conceptually illustrates the interdependence of audio parameters for a "Fly: Back to Front" preset. The figure shows a UI of an Up/Down Mixer that includes four audio parameters: Balance 2035, Front/Rear Bias 2040, Left/Right (L/R) Steering Speed 2045, and Left Surround/Right Surround (Ls/Rs) Width 2050. In some embodiments, the UI of the Up/Down Mixer is part of the GUI described by reference to FIGS. 9, 16 and 22. In some embodiments, the UI for UI of the Up/Down Mixer is a pop-up menu. The figure further shows a Mode selector 2030 that provides a drop down menu for the user to select a mode. In this example, the UI represent a "Stereo to Surround" mode. The four example states shown in FIG. 20 provide an illustration of the non-linear correlation in changes of interdependent audio parameter in some embodiments. The example further shows the interdependence includes a mix of positive and negative correlations in the adjustments of these parameters.

At a first state 2005 of the Fly: Back to Front preset, the Balance value is set at 20, the Front/Rear Bias value is set at −100, the L/R Steering speed is set at 50, and the Ls/Rs Width is set at 3.0. When the panning preset progresses from a first state 2005 to a second state 2010, or when a user manually selects a new value for a first parameter of the panning preset, the panning preset automatically adjusts the values of all the remaining interdependent parameters. In this example, the second state 2010 shows that a new Balance value of 0 has been selected. In response to the new Balance value, the panning preset automatically reduces the Ls/Rs Width to 2.25 as a result of the interdependence of the parameters. The panning preset adjusts the Ls/Rs Width in response to the new Balance value to create a combination of the two parameters that represents the second state 2010 of the Fly: Back to Front preset.

A third state 2015 shows the Balance value set at a −20 and the interdependent Ls/Rs Width value having been adjusted to −1.5 to correspond to the new Balance value. At a fourth state 2020 where the Balance value is set at −70, the panning preset causes not only an adjustment to the Ls/Rs Width value, but also an adjustment to the Front/Rear Bias value. For this preset, a Balance value of −20 corresponds to a Ls/Rs Width value of 2.438 and a Front/Rear Bias value of −62.5.

The fourth state further illustrates that the interdependence of two parameter values are not only non-linear, but that the interdependence of two parameters switches from a positive correlation to a negative correlation in some embodiments. This is shown by the change in parameter values during a progression from the second to third states and from the third to fourth states. As shown in the progression from the second state 2010 to third state 2015, the selection of a lower Balance value results in a lower Ls/Rs Width value. However, the progression from the third state 2015 to the fourth state 2020 shows that further reducing the Balance value to −70 causes the Ls/Rs Width value to increase to 2.438. The complexity of the relationships of audio parameters between different states of a panning preset shown in this example indicates the difficulties a user would face in trying to keyframe this behavior. Providing presets to process media clips enables a user to forgo the intricacies of low level controls and simply apply the high level behaviors to achieve the desired effects.

The rationale behind the variety of correlations between interdependent parameters is explained by the derivation of the set of parameter values. The above examples explain the interdependent adjustments in the audio parameters values as changes in one parameter causing changes in another; however these representations are provided as high level abstractions to facilitate user operation of the media-editing application. The sets of audio parameter values are in fact discrete instances of different states of a panning preset. Each state of a panning preset is defined by a set of audio parameter that produce the audio effect represented by that state of the panning preset (i.e., a state value of −90° for a Circle preset causes the panning preset to set the parameters values such that the sound source appears to originate from the left side of the sound field). Each additional state is defined by additional sets of audio parameters that produce a corresponding audio effect. Furthermore, since the states are not continuously defined for every state value of a particular panning preset, the parameter values corresponding to additional states must be interpolated by applying a mathematical function based on the parameter values of states that have been defined. Accordingly, each state value corresponds to a snapshot of audio parameters, either defined or interpolated, that produce the audio effect of the panning preset for that state value.

IV. Software Architecture

Many of the above-described features and applications are implemented as software processes that are specified as a set of instructions recorded on a computer readable storage medium (also referred to as computer readable medium). When these instructions are executed by one or more computational elements (such as processors or other computational elements like application specific integrated circuits (ASICs) and field programmable gate arrays (FPGAs)), they cause the computational elements to perform the actions indicated in the instructions. Computer is meant in its broadest sense, and can include any electronic device with a processor. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs when installed to operate on one or more computer systems define one or more specific machine implementations that execute and perform the operations of the software programs.

Figure 21:
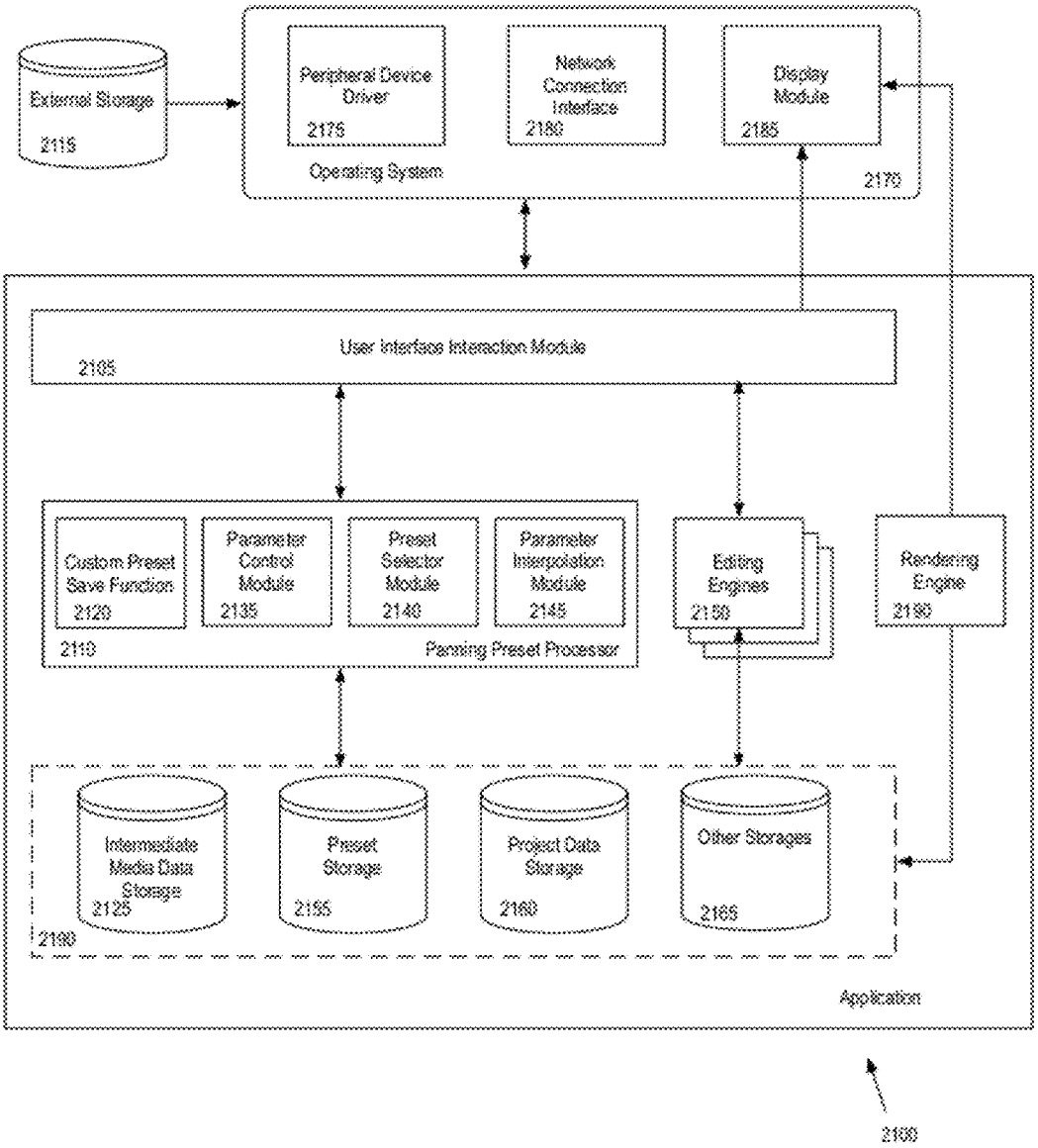
FIG. 21 conceptually illustrates the software architecture of a media-editing application in some embodiments.

In some embodiments, the processes described above are implemented as software running on a particular machine, such as a computer or a handheld device, or stored in a computer readable medium. FIG. 21 conceptually illustrates the software architecture of a media-editing application 2100 of some embodiments. In some embodiments, the media-editing application is a stand-alone application or is integrated into another application, while in other embodiments the application might be implemented within an operating system. Furthermore, in some embodiments, the application is provided as part of a server-based solution. In some of these embodiments, the application is provided via a thin client. That is, the application runs on a server while a user interacts with the application via a separate machine that is remote from the server. In other such embodiments, the application is provided via a thick client. That is, the application is distributed from the server to the client machine and runs on the client machine.

Media-editing application 2100 includes a user interface (UI) interaction module 2105, a panning preset processor 2110, editing engines 2150 and a rendering engine 2190. The media-editing application also includes intermediate media data storage 2125, preset storage 2155, project data storage 2160, and other storages 2165. In some embodiments, the intermediate media data storage 2125 stores media clips that have been processed by modules of the panning preset processor, such as the imported media clips that have had panning presets applied. In some embodiments, storages 2125, 2155, 2160, and 2165 are all stored in one physical storage 2190. In other embodiments, the storages are in separate physical storages, or three of the storages are in one physical storage, while the fourth storage is in a different physical storage.

FIG. 21 also illustrates an operating system 2170 that includes a peripheral device driver 2175, a network connection interface 2180, and a display module 2185. In some embodiments, as illustrated, the peripheral device driver 2175, the network connection interface 2180, and the display module 2185 are part of the operating system 2170, even when the media-editing application is an application separate from the operating system.

The peripheral device driver 2175 may include a driver for accessing an external storage device 2115 such as a flash drive or an external hard drive. The peripheral device driver 2175 delivers the data from the external storage device to the UI interaction module 2105. The peripheral device driver 2175 may also include a driver for translating signals from a keyboard, mouse, touchpad, tablet, touchscreen, etc. A user interacts with one or more of these input devices, which send signals to their corresponding device drivers. The device driver then translates the signals into user input data that is provided to the UI interaction module 2105.

The present application describes a graphical user interface that provides users with numerous ways to perform different sets of operations and functionalities. In some embodiments, these operations and functionalities are performed based on different commands that are received from users through different input devices (e.g., keyboard, trackpad, touchpad, mouse, etc.). For example, the present application illustrates the use of a cursor in the graphical user interface to control (e.g., select, move) objects in the graphical user interface. However, in some embodiments, objects in the graphical user interface can also be controlled or manipulated through other controls, such as touch control. In some embodiments, touch control is implemented through an input device that can detect the presence and location of touch on a display of the input device. An example of a device with such functionality is a touch screen device (e.g., as incorporated into a smart phone, a tablet computer, etc.). In some embodiments with touch control, a user directly manipulates objects by interacting with the graphical user interface that is displayed on the display of the touch screen device. For instance, a user can select a particular object in the graphical user interface by simply touching that particular object on the display of the touch screen device. As such, when touch control is utilized, a cursor may not even be provided for enabling selection of an object of a graphical user interface in some embodiments. However, when a cursor is provided in a graphical user interface, touch control can be used to control the cursor in some embodiments.

The UI interaction module 2105 also manages the display of the UI, and outputs display information to the display module 2185. The display module 2185 translates the output of a user interface for an audio/visual display device. That is, the display module 2185 receives signals (e.g., from the UI interaction module 2105) describing what should be displayed and translates these signals into pixel information that is sent to the display device. The display module 2185 also receives signals from a rendering engine 2190 and translates these signals into pixel information that is sent to the display device. The display device may be an LCD, plasma screen, CRT monitor, touchscreen, etc.

The network connection interface 2180 enables the device on which the media-editing application 2100 operates to communicate with other devices (e.g., a storage device located elsewhere in the network that stores the media clips) through one or more networks. The networks may include wireless voice and data networks such as GSM and UMTS, 802.11 networks, wired networks such as Ethernet connections, etc.

The UI interaction module 2105 of media-editing application 2100 interprets the user input data received from the input device drivers and passes it to various modules in the panning preset processor 2110, including the custom preset save function 2120, the parameter control module 2135, the preset selector module 2140, and the parameter interpolation module 2145. The UI interaction module also manages the display of the UI, and outputs this display information to the display module 2185. The UI display information may be based on information from the editing engines 2150, from preset storage 2155, or directly from input data (e.g., when a user moves an item in the UI that does not affect any of the other modules of the application 2100).

The editing engines 2150 receive media clips (from an external storage via the UI module 2105 and the operating system 2170), and stores the media clips into intermediate media data storage 2125. The editing engines 2150 also fetch the media clips and adjusts the audio parameter values of the media clips. Each of these functions fetches media clips from the intermediate audio data storage 2125, and performs a set of operations on the fetched data (e.g., determining segments of media clips and applying presets) before storing a set of processed media clips into the intermediate audio data storage 2125.

The parameter interpolation module 2145 retrieves audio parameter values from sets of media clips from the intermediate media data storage 2125 and interpolates additional parameter values. Upon completion of the comparison operation, the parameter interpolation module 2145 saves the interpolated value into the preset storage 2155.

The preset selector module 2140 selects panning presets for applying to media clips fetched from storage. The parameter control module 2135 receives a command from the UI module 2105 and modifies the audio parameters of the media clips. The editing engines 2150 then compile the result of the application of the panning preset and the modulation of parameter and stores that information in projected data storage 2160. The media-editing application 2100 in some embodiments retrieves this information and determines where to output the media clips.

While many of the features have been described as being performed by one module (e.g., the editing engines 2150 and the parameter interpolation module 2145) one of ordinary skill in the art will recognize that the functions described herein might be split up into multiple modules. Similarly, functions described as being performed by multiple different modules might be performed by a single module in some embodiments (e.g., audio detection, data reduction, noise filtering, etc.).

V. Graphical User Interface

Figure 22:
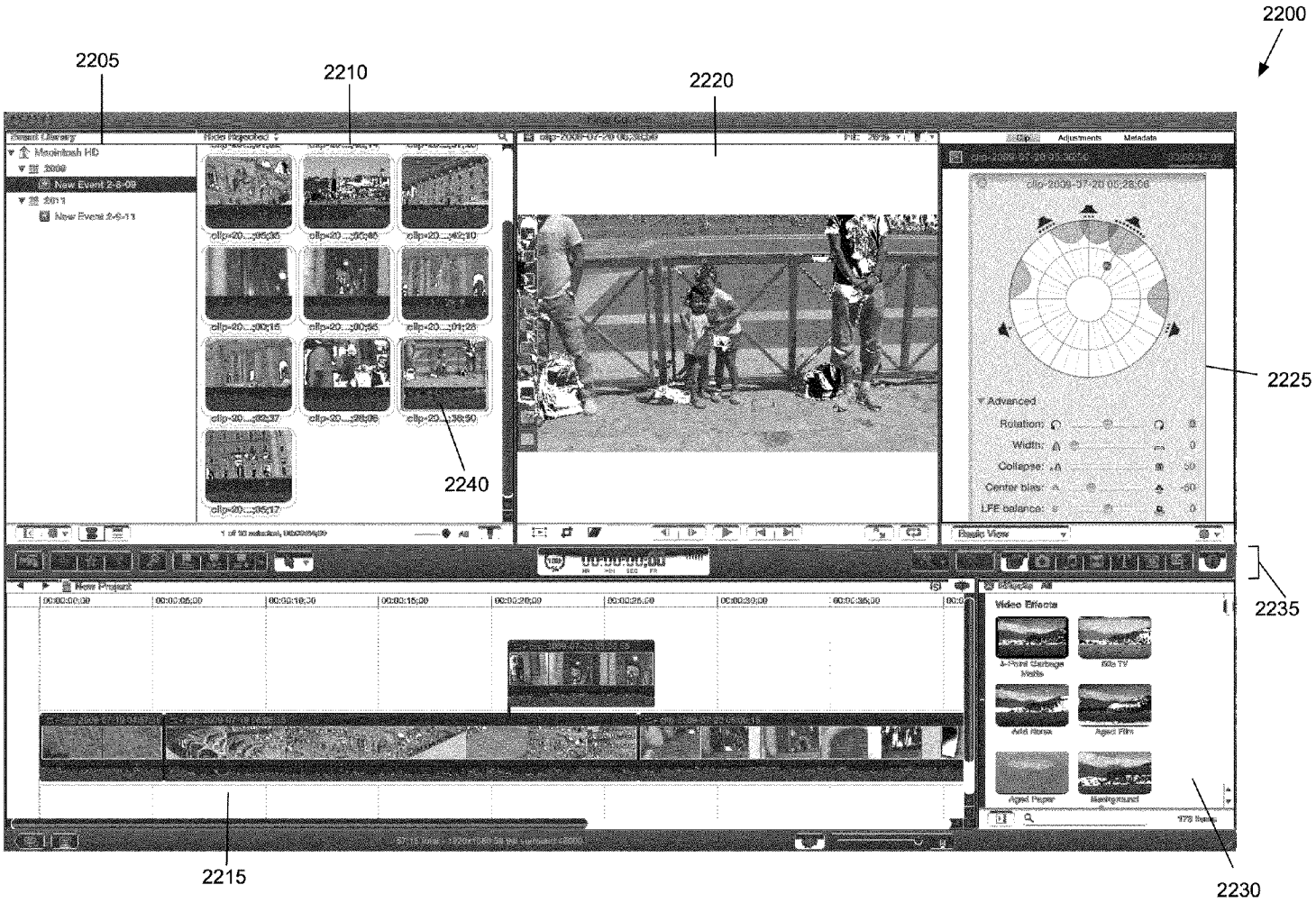
FIG. 22 conceptually illustrates the graphical user interface of a media-editing application in some embodiments.

FIG. 22 illustrates a graphical user interface (GUI) 2200 of a media-editing application of some embodiments. One of ordinary skill will recognize that the graphical user interface 2200 is only one of many possible GUIs for such a media-editing application. In fact, the GUI 2200 includes several display areas which may be adjusted in size, opened or closed, replaced with other display areas, etc. The GUI 2200 includes a clip library 2205, a clip browser 2210, a timeline 2215, a preview display area 2220, an inspector display area 2225, an additional media display area 2230, and a toolbar 2235.

The clip library 2205 includes a set of folders through which a user accesses media clips (i.e. video clips, audio clips, etc.) that have been imported into the media-editing application. Some embodiments organize the media clips according to the device (e.g., physical storage device such as an internal or external hard drive, virtual storage device such as a hard drive partition, etc.) on which the media represented by the clips are stored. Some embodiments also enable the user to organize the media clips based on the date the media represented by the clips was created (e.g., recorded by a camera). As shown, the clip library 2205 includes media clips from both 2125 and 2160.

Within a storage device and/or date, users may group the media clips into "events", or organized folders of media clips. For instance, a user might give the events descriptive names that indicate what media is stored in the event (e.g., the "New Event 2-8-09" event shown in clip library 2205 might be renamed "European Vacation" as a descriptor of the content). In some embodiments, the media files corresponding to these clips are stored in a file storage structure that mirrors the folders shown in the clip library.

Within the clip library, some embodiments enable a user to perform various clip management actions. These clip management actions may include moving clips between events, creating new events, merging two events together, duplicating events (which, in some embodiments, creates a duplicate copy of the media to which the clips in the event correspond), deleting events, etc. In addition, some embodiments allow a user to create sub-folders of an event. These sub-folders may include media clips filtered based on tags (e.g., keyword tags). For instance, in the "New Event 2-8-09" event, all media clips showing children might be tagged by the user with a "kids" keyword, and then these particular media clips could be displayed in a sub-folder of the event that filters clips in this event to only display media clips tagged with the "kids" keyword.

The clip browser 2210 allows the user to view clips from a selected folder (e.g., an event, a sub-folder, etc.) of the clip library 2205. As shown in this example, the folder "New Event 2-8-09" is selected in the clip library 2205, and the clips belonging to that folder are displayed in the clip browser 2210. Some embodiments display the clips as thumbnail filmstrips, as shown in this example. By moving a cursor (or a finger on a touchscreen) over one of the thumbnails (e.g., with a mouse, a touchpad, a touchscreen, etc.), the user can skim through the clip. That is, when the user places the cursor at a particular horizontal location within the thumbnail filmstrip, the media-editing application associates that horizontal location with a time in the associated media file, and displays the image from the media file for that time. In addition, the user can command the application to play back the media file in the thumbnail filmstrip.

In addition, the thumbnails for the clips in the browser display an audio waveform underneath the clip that represents the audio of the media file. In some embodiments, as a user skims through or plays back the thumbnail filmstrip, the audio plays as well.

Many of the features of the clip browser are user-modifiable. For instance, in some embodiments, the user can modify one or more of the thumbnail size, the percentage of the thumbnail occupied by the audio waveform, whether audio plays back when the user skims through the media files, etc. In addition, some embodiments enable the user to view the clips in the clip browser in a list view. In this view, the clips are presented as a list (e.g., with clip name, duration, etc.). Some embodiments also display a selected clip from the list in a filmstrip view at the top of the browser so that the user can skim through or playback the selected clip.

The timeline 2215 provides a visual representation of a composite presentation (or project) being created by the user of the media-editing application. Specifically, it displays one or more geometric shapes that represent one or more media clips that are part of the composite presentation. The timeline 2215 of some embodiments includes a primary lane (also called a "spine", "primary compositing lane", or "central compositing lane") as well as one or more secondary lanes (also called "anchor lanes"). The spine represents a primary sequence of media which, in some embodiments, does not have any gaps. The clips in the anchor lanes are anchored to a particular position along the spine (or along a different anchor lane). Anchor lanes may be used for compositing (e.g., removing portions of one video and showing a different video in those portions), B-roll cuts (i.e., cutting away from the primary video to a different video whose clip is in the anchor lane), audio clips, or other composite presentation techniques.

The user can add media clips from the clip browser 2210 into the timeline 2215 in order to add the clip to a presentation represented in the timeline. Within the timeline, the user can perform further edits to the media clips (e.g., move the clips around, split the clips, trim the clips, apply effects to the clips, etc.). The length (i.e., horizontal expanse) of a clip in the timeline is a function of the length of media represented by the clip. As the timeline is broken into increments of time, a media clip occupies a particular length of time in the timeline. As shown, in some embodiments the clips within the timeline are shown as a series of images. The number of images displayed for a clip varies depending on the length of the clip in the timeline, as well as the size of the clips (as the aspect ratio of each image will stay constant).

As with the clips in the clip browser, the user can skim through the timeline or play back the timeline (either a portion of the timeline or the entire timeline). In some embodiments, the playback (or skimming) is not shown in the timeline clips, but rather in the preview display area 2220.

In some embodiments, the preview display area 2220 (also referred to as a "viewer") displays images from video clips that the user is skimming through, playing back, or editing. These images may be from a composite presentation in the timeline 2215 or from a media clip in the clip browser 2210. In this example, the user has been skimming through the beginning of video clip 2240, and therefore an image from the start of this media file is displayed in the preview display area 2220. As shown, some embodiments will display the images as large as possible within the display area while maintaining the aspect ratio of the image.

The inspector display area 2225 displays detailed properties about a selected item and allows a user to modify some or all of these properties. In some embodiments, the inspector displays the composite audio output information related to a user selected panning preset for a selected clip. In some embodiments, the clip that is shown in the preview display area 2220 is selected, and thus the inspector display area 2225 displays the composite audio output information about media clip 2240. This information includes the audio channels and audio levels to which the audio data is output. In some embodiments, different composite audio output information is displayed depending on the panning preset selected. As discussed above in detail by reference to FIGS. 9 and 16, the composite audio output information displayed in the inspector also includes user adjustable settings. For example, in some embodiments the user may adjust the puck to change the state of the panning preset. The user may also adjust certain settings (e.g. Rotation, Width, Collapse, Center bias, LFE balance, etc.) by manipulating the slider controls along the slider tracks, or by manually entering parameter values.

The additional media display area 2230 displays various types of additional media, such as video effects, transitions, still images, titles, audio effects, standard audio clips, etc. In some embodiments, the set of effects is represented by a set of selectable UI items, each selectable UI item representing a particular effect. In some embodiments, each selectable UI item also includes a thumbnail image with the particular effect applied. The display area 2230 is currently displaying a set of effects for the user to apply to a clip. In this example, several video effects are shown in the display area 2230.

The toolbar 2235 includes various selectable items for editing, modifying what is displayed in one or more display areas, etc. The right side of the toolbar includes various selectable items for modifying what type of media is displayed in the additional media display area 2230. The illustrated toolbar 2235 includes items for video effects, visual transitions between media clips, photos, titles, generators and backgrounds, etc. In addition, the toolbar 2235 includes an inspector selectable item that causes the display of the inspector display area 2225 as well as the display of items for applying a retiming operation to a portion of the timeline, adjusting color, and other functions.

The left side of the toolbar 2235 includes selectable items for media management and editing. Selectable items are provided for adding clips from the clip browser 2210 to the timeline 2215. In some embodiments, different selectable items may be used to add a clip to the end of the spine, add a clip at a selected point in the spine (e.g., at the location of a playhead), add an anchored clip at the selected point, perform various trim operations on the media clips in the timeline, etc. The media management tools of some embodiments allow a user to mark selected clips as favorites, among other options.

One or ordinary skill will also recognize that the set of display areas shown in the GUI 2200 is one of many possible configurations for the GUI of some embodiments. For instance, in some embodiments, the presence or absence of many of the display areas can be toggled through the GUI (e.g., the inspector display area 2225, additional media display area 2230, and clip library 2205). In addition, some embodiments allow the user to modify the size of the various display areas within the UI. For instance, when the display area 2230 is removed, the timeline 2215 can increase in size to include that area. Similarly, the preview display area 2220 increases in size when the inspector display area 2225 is removed.

VI. Electronic System

Many of the above-described features and applications are implemented as software processes that are specified as a set of instructions recorded on a computer readable storage medium (also referred to as computer readable medium). When these instructions are executed by one or more computational or processing unit(s) (e.g., one or more processors, cores of processors, or other processing units), they cause the processing unit(s) to perform the actions indicated in the instructions. Examples of computer readable media include, but are not limited to, CD-ROMs, flash drives, random access memory (RAM) chips, hard drives, erasable programmable read only memories (EPROMs), electrically erasable programmable read-only memories (EEPROMs), etc. The computer readable media does not include carrier waves and electronic signals passing wirelessly or over wired connections.

In this specification, the term "software" is meant to include firmware residing in read-only memory or applications stored in magnetic storage which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

Figure 23:
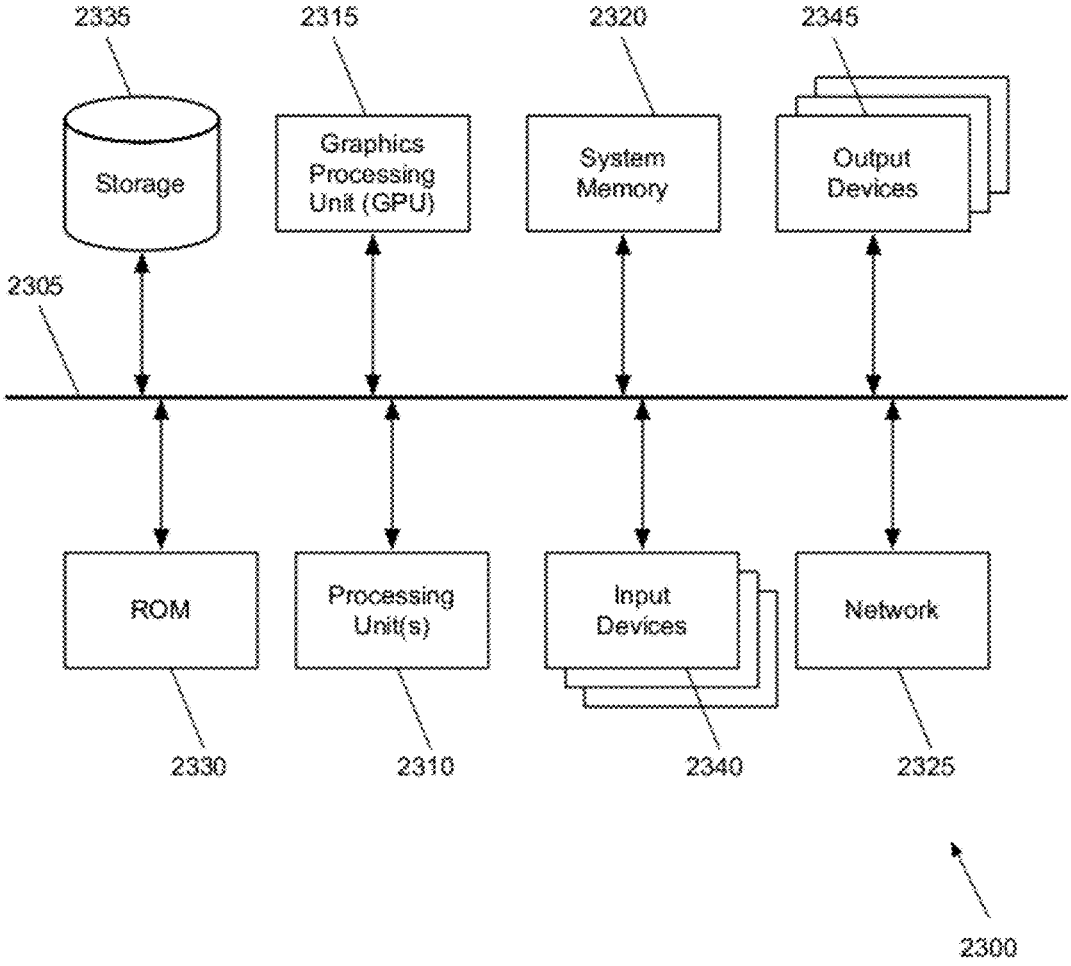
FIG. 23 conceptually illustrates a computer system with which some embodiments of the invention are implemented.

FIG. 23 conceptually illustrates an electronic system 2300 with which some embodiments of the invention are implemented. The electronic system 2300 may be a computer (e.g., a desktop computer, personal computer, tablet computer, etc.), phone, PDA, or any other sort of electronic or computing device. Such an electronic system includes various types of computer readable media and interfaces for various other types of computer readable media. Electronic system 2300 includes a bus 2305, processing unit(s) 2310, a graphics processing unit (GPU) 2315, a system memory 2320, a network 2325, a read-only memory 2330, a permanent storage device 2335, input devices 2340, and output devices 2345.

The bus 2305 collectively represents all system, peripheral, and chipset buses that communicatively connect the numerous internal devices of the electronic system 2300. For instance, the bus 2305 communicatively connects the processing unit(s) 2310 with the read-only memory 2330, the GPU 2315, the system memory 2320, and the permanent storage device 2335.

From these various memory units, the processing unit(s) 2310 retrieves instructions to execute and data to process in order to execute the processes of the invention. The processing unit(s) may be a single processor or a multi-core processor in different embodiments. Some instructions are passed to and executed by the GPU 2315. The GPU 2315 can offload various computations or complement the image processing provided by the processing unit(s) 2310. In some embodiments, such functionality can be provided using CoreImage's kernel shading language.

The read-only-memory (ROM) 2330 stores static data and instructions that are needed by the processing unit(s) 2310 and other modules of the electronic system. The permanent storage device 2335, on the other hand, is a read-and-write memory device. This device is a non-volatile memory unit that stores instructions and data even when the electronic system 2300 is off. Some embodiments of the invention use a mass-storage device (such as a magnetic or optical disk and its corresponding disk drive) as the permanent storage device 2335.

Other embodiments use a removable storage device (such as a floppy disk, flash memory device, etc., and its corresponding disk drive) as the permanent storage device. Like the permanent storage device 2335, the system memory 2320 is a read-and-write memory device. However, unlike storage device 2335, the system memory 2320 is a volatile read-and-write memory, such as random access memory. The system memory 2320 stores some of the instructions and data that the processor needs at runtime. In some embodiments, the invention's processes are stored in the system memory 2320, the permanent storage device 2335, and/or the read-only memory 2330. For example, the various memory units include instructions for processing multimedia clips in accordance with some embodiments. From these various memory units, the processing unit(s) 2310 retrieves instructions to execute and data to process in order to execute the processes of some embodiments.

The bus 2305 also connects to the input devices 2340 and output devices 2345. The input devices 2340 enable the user to communicate information and select commands to the electronic system. The input devices 2340 include alphanumeric keyboards and pointing devices (also called "cursor control devices"), cameras (e.g., webcams), microphones or similar devices for receiving voice commands, etc. The output devices 2345 display images generated by the electronic system or otherwise output data. The output devices 2345 include printers and display devices, such as cathode ray tubes (CRT) or liquid crystal displays (LCD), as well as speakers or similar audio output devices. Some embodiments include devices such as a touchscreen that function as both input and output devices.

Finally, as shown in FIG. 23, bus 2305 also couples electronic system 2300 to a network 2325 through a network adapter (not shown). In this manner, the computer can be a part of a network of computers (such as a local area network ("LAN"), a wide area network ("WAN"), or an Intranet, or a network of networks, such as the Internet. Any or all components of electronic system 2300 may be used in conjunction with the invention.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some embodiments are performed by one or more integrated circuits, such as ASICs or FPGAs. In some embodiments, such integrated circuits execute instructions that are stored on the circuit itself. In addition, some embodiments execute software stored in programmable logic devices (PLDs), ROM, or RAM devices.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium," "computer readable media," and "machine readable medium" are entirely restricted to tangible, physical objects that store information in a form that is readable by a computer. These terms exclude any wireless signals, wired download signals, and any other ephemeral signals.

While the invention has been described with reference to numerous specific details, one of ordinary skill in the art will recognize that the invention can be embodied in other specific forms without departing from the spirit of the invention. In addition, a number of the figures (including FIGS. 7, 10, 12, 13, 15, and 18) conceptually illustrate processes. The specific operations of these processes may not be performed in the exact order shown and described. The specific operations may not be performed in one continuous series of operations, and different specific operations may be performed in different embodiments. Furthermore, the process could be implemented using several sub-processes, or as part of a larger macro process. Thus, one of ordinary skill in the art would understand that the invention is not to be limited by the foregoing illustrative details, but rather is to be defined by the appended claims.

The invention claimed is:

1. A method of editing audio content to produce an audio panning effect, the method comprising:

applying a panning preset from a set of predefined panning presets to a set of audio parameters of the audio content to create the audio panning effect, each panning preset comprising a plurality of sets of predefined values, each set of predefined values having a value corresponding to each audio parameter in the set of audio parameters, the audio parameters comprising parameters for determining a distribution of the audio content across a multi-channel output system, the panning preset applied by setting each of a set of predefined values to a corresponding audio parameter in the set of audio parameters of the audio content;

receiving a value for a particular audio parameter of the set of audio parameters different from a currently set predefined value for the particular audio parameter; and adjusting a remaining set of audio parameters in the set of audio parameters of the audio content based on interdependences between the particular audio parameter and the remaining set of audio parameters in order to control the distribution of the audio content to each channel of the multi-channel output system.

2. The method of claim 1, wherein each set of predefined values is stored as a snapshot corresponding to one of a plurality of states of the panning preset, each snapshot being applied to the audio content as a function of time.

3. The method of claim 2, wherein the multi-channel output system comprises a multi-speaker system, wherein applying each snapshot associated with the applied panning preset controls the distribution of the audio content to each speaker of the multi-speaker system.

4. The method of claim 3, wherein a progression through successive states of the applied panning preset changes the distribution of the audio content across each speaker of the multi-channel speaker system.

5. The method of claim 3, wherein applying each snapshot associated with the applied panning preset to control the distribution of the audio content to each speaker of the multi-speaker system produces an effect of an audio movement along a predetermined path.

6. A method of editing audio content to produce an audio panning effect, the method comprising:

receiving a selection of a panning preset from a set of predefined panning presets for modifying a set of audio parameters of the audio content to create the audio panning effect, each panning preset comprising a plurality of sets of predefined values, each set of predefined values having a value corresponding to each audio parameter in the set of audio parameters;

setting each of a set of predefined values of the selected panning preset to a corresponding audio parameter in the set of audio parameters of the audio content;

receiving a value for a particular audio parameter of the set of audio parameters different from a currently set predefined value for the particular audio parameter; and adjusting a remaining set of audio parameters in the set of audio parameters of the audio content based on interdependences between the particular audio parameter and the remaining set of audio parameters to produce the audio panning effect in order to control distribution of the audio content to each channel of a multi-channel speaker system.

7. The method of claim 6 further comprising adjusting a progression rate of the panning preset by changing a length of a portion of a media clip to which the panning preset is applied, wherein when a first portion of the media clip is shorter than a second portion of the media clip, applying the panning preset to the first portion causes a higher progression rate of the panning preset.

8. The method of claim 6, wherein each set of predefined values is stored as a snapshot corresponding to one of a plurality of states of the panning preset.

9. The method of claim 8, wherein a progression through successive states of the panning preset produces the audio panning effect by modulating individual outputs to each channel of the multi-channel speaker system as a function of time.

10. The method of claim 8 further comprising scaling an elapsed time of each portion of a media clip between the snapshots of the panning preset such that the snapshots are distributed throughout the media clip.

11. The method of claim 8 further comprising applying an interpolation function to determine additional sets of values of audio parameters for additional states of the panning preset based on the stored snapshots of the panning preset.

12. The method of claim 8, wherein the set of predefined values of each snapshot is applied to the audio content as a function of time, each snapshot changing the values of the audio parameters of the audio content at a predetermined point in time.

13. The method of claim 12, wherein the panning effect is a directional panning effect that creates a sense of audio movement along a predetermined path.

14. The method of claim 12, wherein the panning effect is a non-directional panning effect that distributes the audio content to the multi-channel speaker system to produce the audio panning effect.

15. A method of editing a media clip having audio content to produce an audio panning effect, the method comprising:

receiving a selection of a panning preset from a set of predefined panning presets for modifying a set of audio parameters of the audio content to create the audio panning effect, each panning preset comprising a plurality of sets of predefined numerical values, each set of predefined numerical values having a numerical value for each audio parameter in the set of audio parameters and stored as a different state of the panning preset, the set of audio parameters comprising parameters for determining a distribution of the audio content across a multi-channel output system, each state of the selected panning preset comprising at least one audio parameter value that is different from values of a same audio parameter for all other states of the panning preset;

receiving a selection of a particular state of the panning preset; and setting a numerical value of each audio parameter in the set of audio parameters of the audio content to the corresponding predefined numerical value in the set of predefined numerical values stored as the particular state of the panning preset to distribute the audio content to the multi-channel output system to produce a non-directional panning effect of the audio content.

16. The method of claim 15 further comprising setting the numerical value of each audio parameter in the set of audio parameters of the audio content to the corresponding predefined numerical value in a set of predefined numerical values representing a predefined default state of the panning preset to audio parameters of the audio content when the selection of the particular state is not received.

17. The method of claim 15, wherein the particular state of the panning preset is a first state of the panning preset, the method further comprising:

receiving a selection of a second state of the panning preset during a playback of the audio content, and setting the numerical value of each audio parameter in the set of audio parameters of the audio content to each corresponding numerical value of a set of numerical values corresponding to the second state of the panning preset to a remaining unplayed portion of the audio content of the playback.

18. A method of authoring a custom panning preset for editing media clips having audio content to produce an audio panning effect, the method comprising:

receiving at least two sets of numerical values, each set of numerical values having a numerical value for each audio parameter in a set of audio parameters, the audio parameters comprise parameters for determining a distribution of the audio content across a multi-channel output system comprising multiple speakers;

for each received set of numerical values, receiving a selection of a particular state corresponding to each of the sets of numerical values; and storing each selected state and the corresponding set of numerical values as a snapshot of the custom panning preset, wherein applying the custom panning preset to the audio content (i) sets numerical values for each audio parameter in the set of audio parameters to corresponding numerical values in a set of numerical values at each corresponding state in the stored snapshots, and (ii) distributes the audio content across a multi-channel output system comprising multiple speakers to produce the audio panning effect.

19. The method of claim 18, wherein each of the received sets of numerical values includes at least one numerical value of a particular audio parameter that is different from numerical values of a same audio parameter for all other received sets of numerical values.

20. The method of claim 18 further comprising interpolating the stored snapshots to determine additional sets of numerical values corresponding to additional states of the custom panning preset.

21. The method of claim 20, wherein interpolating comprises utilizing a non-linear interpolation function.

22. A non-transitory computer readable storage medium storing a media editing application for editing media clips having audio content to produce audio panning effects, the media editing application executable by at least one processing unit, the media editing application comprising sets of instructions for:

receiving a selection of a particular panning preset from a set of predefined panning presets for modifying a set of audio parameters of the audio content to create the audio panning effect, each panning preset comprising a plurality of sets of predefined values corresponding to the set of audio parameters, each set of predefined values being associated with a different state of the panning preset;

receiving a selection of a particular state of the panning preset;

applying the sets of predefined values associated with the selected state of the panning preset to the set of audio parameters to produce a first audio panning effect by distributing the audio content across a multi-channel output system;

receiving a value for a particular audio parameter different from the predefined value of the particular audio parameter associated with the selected state of the panning preset; and adjusting a remaining set of audio parameters in the selected state of the panning preset based on a determination of interdependences between the particular audio parameter and the remaining set of audio parameters to produce a second audio panning effect by changing a distribution of the audio content across the multi-channel output system.

23. The non-transitory computer readable storage medium of claim 22, wherein the multi-channel output system comprises a multi-speaker system, wherein the set of instructions for applying the sets of predefined values associated with the selected state of the panning preset further comprises a set of instructions for controlling the distribution of the audio content to each speaker of the multi-speaker system.

24. The non-transitory computer readable storage medium of claim 22, wherein the sets of instructions for adjusting the remaining set of audio parameters comprises sets of instructions for:

making a determination that the received value for the particular audio parameter corresponds to another particular state; and applying a set of values corresponding to the other particular state to the audio content.

* * * * *